United States Patent [19]

Derby et al.

[11] Patent Number: 4,457,456

[45] Date of Patent: Jul. 3, 1984

[54] COLLAPSIBLE RECEPTACLE WITH STATIC ELECTRIC CHARGE ELIMINATION

[75] Inventors: Norwin C. Derby; Robert R. Williamson, both of Dallas, Tex.

[73] Assignee: Super Sack Manufacturing Company, Dallas, Tex.

[21] Appl. No.: 403,811

[22] Filed: Jul. 30, 1982

Related U.S. Application Data

[63] Continuation-in-part of Ser. No. 336,455, Dec. 31, 1981, which is a continuation-in-part of Ser. No. 281,406, Jul. 8, 1981, abandoned, which is a continuation of Ser. No. 046,822, Jun. 8, 1979, abandoned.

[51] Int. Cl.[3] ..... B65D 33/38

[52] U.S. Cl. ..... 222/105; 222/181; 222/190; 222/527; 141/114; 361/212

[58] Field of Search ..... 222/190, 105, 107, 92, 222/181, 185, 527, 528, 530; 150/1, 2, 7, 11, 12, 33; 141/114, 10, 68, 313; 57/901; 2/73; 361/215, 220, 212

[56] References Cited

U.S. PATENT DOCUMENTS

| | | |
|---|---|---|
| 546,168 | 9/1895 | Lobdell . |
| 616,249 | 12/1898 | Nickerson . |
| 733,542 | 7/1903 | Converse . |
| 1,335,607 | 3/1920 | Salisbury . |
| 1,815,106 | 7/1931 | Jostes . |
| 2,009,511 | 7/1935 | Nydegger . |
| 2,047,095 | 7/1936 | Booth . |
| 2,096,161 | 10/1937 | Curran . |
| 2,301,128 | 11/1942 | Landefeld . |
| 2,314,876 | 3/1943 | Greene . |
| 2,361,943 | 11/1944 | Issoglio . |
| 2,507,939 | 5/1950 | Smith . |
| 2,691,998 | 10/1954 | Stucker . |
| 2,740,445 | 4/1956 | Fornell . |
| 2,969,102 | 1/1961 | Cunningham . |
| 3,072,512 | 1/1963 | Dalle . |
| 3,096,013 | 7/1963 | Kugler . |
| 3,282,757 | 11/1966 | Brussee . |
| 3,328,226 | 6/1967 | Wiley . |
| 3,351,365 | 11/1967 | Bickl . |
| 3,374,929 | 3/1968 | Silfverskiold . |
| 3,430,815 | 3/1969 | Weimer et al. . |
| 3,445,055 | 5/1969 | Fort et al. . |
| 3,531,365 | 9/1970 | Melin . |
| 3,540,356 | 11/1970 | Lecomte . |
| 3,555,170 | 1/1971 | Thessalonikis et al. ..... 361/215 |
| 3,570,749 | 3/1971 | Sato et al. . |
| 3,581,883 | 6/1971 | Whitney . |
| 3,589,506 | 6/1971 | Ford et al. . |
| 3,596,134 | 7/1971 | Burke ..... 361/220 |

(List continued on next page.)

FOREIGN PATENT DOCUMENTS

| | | |
|---|---|---|
| 523764 | 4/1931 | Fed. Rep. of Germany . |
| 2505041 | 10/1975 | Fed. Rep. of Germany . |
| 2512014 | 9/1976 | Fed. Rep. of Germany . |
| 2141498 | 1/1973 | France . |
| 413476 | 11/1962 | Switzerland . |
| 9560 | of 1905 | United Kingdom . |
| 339825 | 12/1930 | United Kingdom . |
| 360733 | 11/1931 | United Kingdom . |
| 867107 | 5/1961 | United Kingdom . |
| 915999 | 1/1963 | United Kingdom . |
| 1097040 | 12/1967 | United Kingdom . |
| 1177745 | 1/1970 | United Kingdom . |
| 1317398 | 5/1973 | United Kingdom . |
| 1340693 | 12/1973 | United Kingdom . |
| 1468902 | 3/1977 | United Kingdom . |

*Primary Examiner*—H. Grant Skaggs
*Attorney, Agent, or Firm*—Michael A. O'Neil

[57] ABSTRACT

A collapsible receptacle (570) has a bottom wall (574) provided with a discharge spout (582). The discharge spout (582) is provided with an interior layer (586) which is grounded during the flow of material through the discharge spout to prevent the buildup of static electric charge therein. The bottom wall (574) may also be provided with an electrically conductive layer (592) to further prevent the buildup of static electric charge in materials flowing out of the collapsible receptacle (570) through the discharge spout (582). The conductive layers (586, 592) may be electrically interconnected.

6 Claims, 55 Drawing Figures

U.S. PATENT DOCUMENTS 3,596,824 8/1971 Lehmacher et al. .
3,607,616 9/1971 Barbehenn et al. .
3,620,774 11/1971 Ford et al. .
3,623,937 11/1971 Gasaway .
3,661,322 5/1972 Norman .
3,666,585 5/1972 Barbehenn .
3,671,383 6/1972 Sakata et al. .
3,701,559 3/1973 Marino et al. .
3,742,664 7/1973 Reding .
3,754,053 8/1973 Kray et al. .
3,754,063 8/1973 Schirmer .
3,789,897 2/1974 Saito .
3,798,115 3/1974 Hofmann et al. .
3,827,471 8/1974 Gregory et al. .
3,865,339 2/1975 Alven .
3,874,989 4/1975 Strange et al. .
3,893,595 7/1975 Khanna et al. .
3,907,955 9/1975 Viénnot ..... 361/215
3,961,655 6/1976 Nattrass et al. ..... 150/1
3,982,986 9/1976 Stone et al. .
4,010,784 3/1977 Nattrass et al. .
4,081,011 3/1978 Krause .
4,107,452 8/1978 Razvi ..... 361/215
4,113,146 9/1978 Williamson .
4,143,796 3/1979 Williamson et al. ..... 222/185
4,194,652 3/1980 Williamson et al. .
4,221,250 9/1980 Manerba .
4,224,970 9/1980 Williamson et al. .

COLLAPSIBLE RECEPTACLE WITH STATIC ELECTRIC CHARGE ELIMINATION

CROSS REFERENCE TO RELATED APPLICATIONS

This application is a continuation-in-part of U.S. patent application Ser. No. 336,455, filed 12/31/81, which is a continuation-in-part of application Ser. No. 281,406, filed July 8, 1981, now abandoned which in turn is a continuation of U.S. patent application Ser. No. 046,822 filed June 8, 1979, now abandoned.

TECHNICAL FIELD

This invention relates to a collapsible receptacle which is useful in handling flowable materials in semi-bulk quantities, and more particularly to such a receptacle wherein the lift loops are prefabricated for attachment to the upper end of the receptacle side wall.

BACKGROUND ART

The handling of particulate, granular or other flowable materials involves several problems. Such materials include chemicals, minerals, fertilizers, foodstuffs, grains, agricultural products and the like. Materials like these have generally been handled in two fashions.

Bulk handling equipment, including railroad cars, barges, trucks and the like, is employed when large quantities of material are required. Such bulk handling equipment, however, is of limited versatility. Only large quantities of materials can be handled efficiently, and only at those locations accessible to such equipment. In addition, sanitary standards are more difficult to maintain with bulk handling equipment because the materials are often exposed during at least part of the handling.

Container systems have been developed for handling relatively smaller quantities of material. The containers are individually filled, loaded for transportation to a point of distribution or use, unloaded, opened and emptied. Although containers can be more convenient in some respects, higher handling costs are usually incurred because less material is carried per container. The return freight costs of reusable containers can be substantial, particularly for rigid or noncollapsible containers.

There has been increasing interest in the use of flexible, collapsible containers for handling semi-bulk quantities of materials. The advantages of such receptacles include relatively low weight, reduced cost, better versatility, and low return freight costs in the case of reusable receptacles. One disadvantage of some flexible receptacles, however, is that they are not self-supporting and must therefore be handled with the aid of pallets or the like. Other flexible receptacles incorporate external sling assemblies for purposes of self-support. Two successful examples of receptacles with external sling constructions can be found in U.S. Pat. Nos. 4,113,146 and 4,143,796 to Williamson and Williamson and Derby, respectively. In other instances collapsible receptacles with integral sling structures, i.e., lift loops, have not exhibited adequate strength, particularly when a single lift loop is required to support the entire load contained by the receptacle.

DISCLOSURE OF INVENTION

The present invention comprises a material receptacle which overcomes the foregoing and other difficulties associated with the prior art. The invention comprises a new and improved collapsible receptacle for handling materials in semi-bulk quantities. The receptacle features top loading and bottom discharge. The receptacle herein can be used with virtually any flowable material, including minerals, chemicals, fertilizers, foodstuffs, agricultural products and the like. The receptacle of the present invention can be sized to handle from about six to eight-four cubic feet of material, or up to about 3,000 pounds by weight. The construction of the receptacle herein functions as an integral sling, whereby an external sling assembly is neither desirable nor necessary. The invention lends itself to simplified construction, and is therefore less expensive than collapsible receptacles incorporating external sling assemblies.

More specifically, the present invention comprises a collapsible receptacle with a built-in sling. The receptacle is formed primarily of rectangular panels of flexible but substantially inextensible material. Woven polypropylene or woven polyethylene materials can be utilized in constructing the invention. The receptacle herein includes a number of side panels, two of which are relatively longer than the other side panels. The side panels are arranged and secured together along the side edges thereof. The longer side panels are folded back and secured to themselves to form opposing lift loops or sleeves extending substantially the width of the receptacle. A bottom panel is secured between the bottom edges of the side panels, while a top panel with a fill spout therein is secured between the top edges of the side panels. If desired, a discharge spout can be mounted in the bottom panel.

In another embodiment of the invention, reinforced material is utilized for the two side panels having the lift sleeves at the tops thereof. The reinforced material comprises woven polypropylene or woven polyethylene with continuous longitudinal strands of polyester woven directly therein. The reinforcing polyester strands can be provided in the material as selvage or bands.

In another aspect of the invention, a combination top/bottom panel assembly can be used in constructing the receptacle. The assembly includes a panel with an opening positioned centrally therein. The opening is preferably oblong or oval in shape and is at least as wide in the long direction as the maximum bridging distance of the material being handled. A spout is positioned in the opening and secured to the panel. The assembly can be used in this form as a top panel for the receptacle. To convert to a bottom panel construction, a closure assembly is secured to the panel about the spout.

In yet another embodiment of the invention, the receptacle is formed from a single piece of material. Preferably, a receptacle blank is formed by making predetermined cutouts through a length of flattened circular or tubular material. The forward and trailing ends of the receptacle blank correspond so that blanks can be cut sequentially from an advancing supply of tubular material without waste. Openings for the fill and discharge spouts are cut into the receptacle blank as desired. The blank is then folded and secured to form a collapsible receptacle with an integral sling.

In still another embodiment of the invention, the receptacle is formed of at least one sheet of flexible material having two side edges and top and bottom edges with a generally rectangular shape. The material is folded along first parallel folds proximate its center to define a first side panel between the top and bottom edges and first folds. The material is further folded along second and third parallel folds on either side of the first folds to form second and third side panels on either side of the first panel formed of opposed pairs of collapsible halves. Structure is provided for fastening the side edges of the sheet of material between the third folds to form a fourth side panel opposed to the first panel, the sheet being collapsible to a flat form for storage and expandable to form a rectangular tube.

In accordance with another aspect of the present invention, the collapsible receptacle further includes structure for securing together the panels along the first and third folds proximate the top edge along a line angled toward the top edge from the fold to form a closure at the top end having a generally rectangular shaped hole therethrough. Flaps are formed upstanding from the line of securement by facing portions of the secured sides. A carrying strap may be securd between flaps on the material to permit the sheet of flexible material to be supported therefrom. Reinforcing material may be secured to the carrying strap, flaps and along the adjacent fold to reinforce the receptacle.

In accordance with yet another aspect of the present invention, a method is provided for forming a collapsible receptacle for handling flowable material from a sheet of flexible material having side edges and a top and bottom edge. The method includes the steps of folding the material along first parallel folds proximate the center of the sheet to form a first side panel between the first folds and top and bottom edges. The method further includes the step of folding the material along second and third parallel folds on both sides of the first folds opposite the first panel to form second and third sides, each of the second and third sides formed of adjacent panel halves foldable into facing relation. The method further includes the step of fastening the ends of the sheet together along the side edges to form a fourth side panel opposed to the first side panel, the sheet being foldable to a flattened form and expandable to a rectangular tube. The method concludes with the step of fastening adjacent panels along the first and second folds along lines extending between the folds and top edges to form a top having a rectangular hole therethrough, the adjacent side panels forming flaps extending from the top for lifting the receptacle.

In accordance with yet another embodiment of the invention there is provided a prefabricated structure comprising lift loops for supporting the receptacle and its contents. The prefabricated lift loop structure is then secured to the upper end of the side wall of the receptacle. If desired, the receptacle may be provided with a bottom wall incorporating lift fork receiving members.

Still another aspect of the invention comprises prefabrication of lift loops from a continuous length of webbing material. The webbing material is secured to a length of fabric material which is in turn secured to the receptacle side wall. The lift loop construction may include depending loops which are in turn connected to a string extending under the bottom of the receptacle. Fork lift receiving members may be provided at the bottom of the receptacle for use in those instances when insufficient overhead space prevents use of the lift loops.

Yet another aspect of the invention relates to the elimination of static electric charge from flowable materials as they are discharged from a collapsible receptacle. The receptacle is provided with a discharge spout having an electrically conductive interior surface. As materials are discharged from the receptacle, the conductive interior surface of the spout is grounded, thereby eliminating static electric charge buildup. Similarly, the bottom wall of the receptacle may be provided with a conductive interior surface, which may be electrically connected to the conductive interior surface of the discharge spout.

BRIEF DESCRIPTION OF DRAWINGS

A more complete understanding of the invention can be had by reference to the following Detailed Description in conjunction with the accompanying Drawings, wherein.

DETAILED DESCRIPTION

Figure 1:
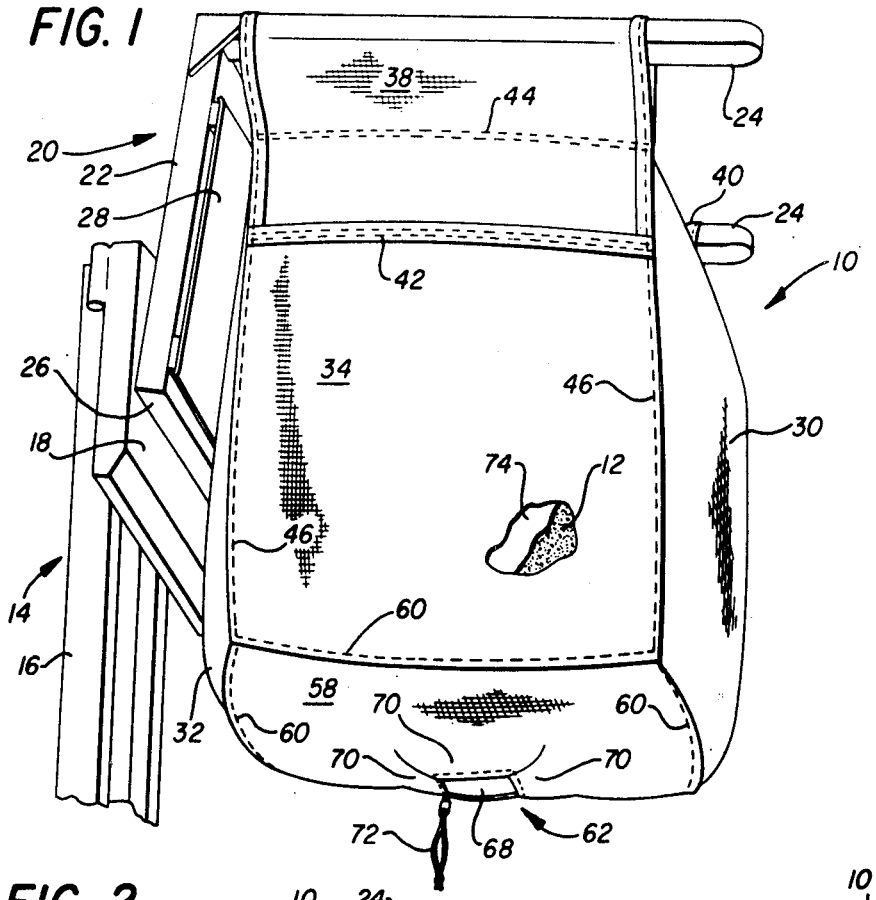
FIG. 1 is a bottom side perspective view of a collapsible receptacle incorporating a first embodiment of the invention.

Referring now to the Drawings, wherein like reference numerals designate like or corresponding parts throughout the several views, and particularly referring to FIG. 1, there is shown a receptacle 10 incorporating a first embodiment of the invention. The receptacle 10 is of flexible, collapsible construction and is useful in handling semi-bulk quantities of material 12. For example, material 12 can comprise minerals, chemicals, fertilizers, foodstuffs, agricultural products or the like.

A forklift assembly 14 supports the receptacle 10 in FIG. 1. Forklift assembly 14 includes a mast 16 on a conventional forklift vehicle (not shown). Mast 16 supports a cross member 18 which is vertically moveable along the mast. Other loading vehicles having different types of lift assemblies can also be utilized.

A fork attachment 20 is connected to the cross member 18. Attachment 20 includes two vertical columns 22 and arms 24 extending outwardly from the upper ends of the columns 22. A plate 28 is secured over crossbars 26. Portions of receptacle 10 are received over arms 24 for support by fork attachment 20.

If desired, receptacle 10 can be lifted and carried by a crane or the like using an attachment having arms similar to arms 24 in fork attachment 20. Receptacle 10 is self-supporting, and no external sling assemblies or pallets are required to handle the receptacle.

Figure 2:
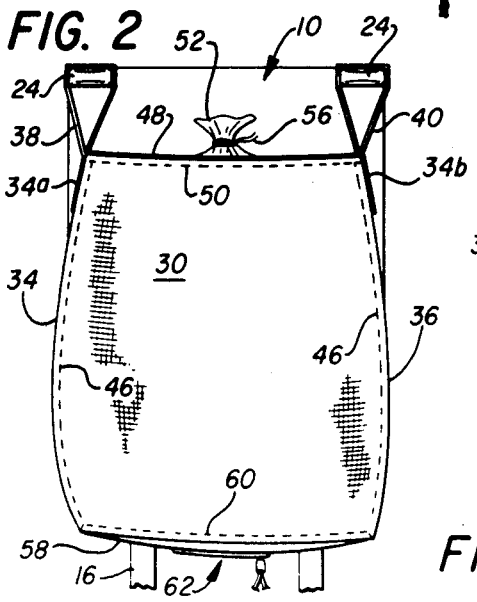
FIG. 2 is a reduced front view of the receptacle shown in FIG. 1.
Figure 3:
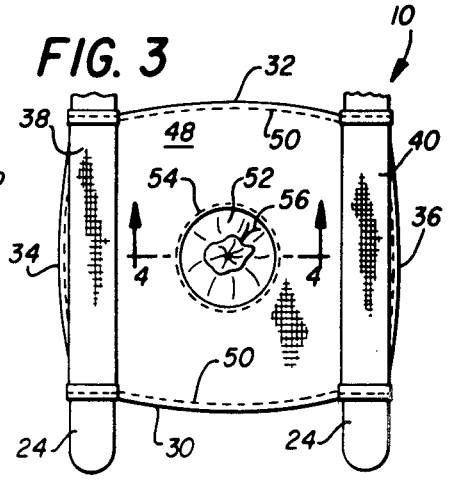
FIG. 3 is a reduced top view of the receptacle shown in FIG. 1.

Constructional details of receptacle 10 are shown in FIGS. 1, 2 and 3. Receptacle 10 comprises front and back side panels 30 and 32, and left and right side panels 34 and 36. Side panels 30, 32, 34 and 36 are all generally rectangular. In accordance with the preferred construction of receptacle 10, side panels 34 and 36 are relatively longer than side panels 30 and 32. The upper ends of side panels 34 and 36 are folded back and secured to themselves to form lift sleeves 38 and 40, respectively. Lift sleeves 38 and 40 thus extend the entire width of side panels 34 and 36, respectively.

In particular, the formation of lift sleeves 38 and 40 proceeds as follows. Each lift sleeve 38 and 40 is formed similarly. With respect to panel 34, the top edge thereof is secured by stitching 42 extending across the panel. Preferably, a second line of stitching 44 is provided across panel 34 above stitching 42. If desired, the top and side edges of panel 34 can be folded inward before provision of stitching 42 and 44 for extra reinforcement of these areas in receptacle 10. It has been found that the two lines of stitching 42 and 44 create a truss-like effect, which is more effective in distributing load between lift sleeve 38 and receptacle 10. Lift sleeve 40 in side panel 36 is formed in similar fashion. It will thus be understood that lift sleeves 38 and 40 extending across the entire width of receptacle 10 are formed directly in an opposing pair of side panels.

The side panels 30, 32, 34 and 36 are joined at the side edges thereof to form an upstanding sidewall in receptacle 10. The side edges of the panels are connected together by means sewn seams 46. Seams, such as plain seams wherein adjacent panels are joined by stitching along a line positioned inwardly from the free edges of the panels, can be used to interconnect each panel 30, 32, 34 and 36 to an adjacent panel. Other suitable types of seams 46 can also be used, if desired. The side panels 30, 32, 34 and 36 are thus interconnected by longitudinal seams 46 extending along the length thereof.

A top panel 48 is secured between the upper ends of side panels 30, 32, 34 and 36. Panel 48 can be of rectangular or square configuration. Panel 48 is secured about the periphery thereof to side panels 30, 32, 34 and 36 by means of stitching 50. A fill spout 52 is mounted in an opening provided centrally in the top panel 48. The spout 52 is generally cylindrical, and is secured by stitching 54 about the circumference of one end to panel 48. A wire tie 56 or other suitable device can be employed to close fill spout 52. It will thus be apparent that flowable material 12 is introduced into receptacle 10 through fill spout 52.

Figure 5:
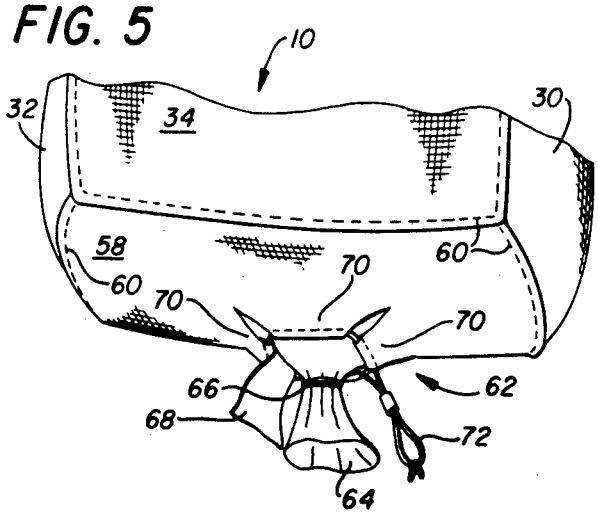
FIG. 5 is a partial perspective view of the bottom of the receptacle shown in FIG. 1 with the discharge spout assembly extended.

Referring now to FIGS. 1, 2 and 5, a bottom panel 58 closes the lower end of receptacle 10. Bottom panel 58 is secured about the periphery thereof by stitching 60 to the bottom edges of panels 30, 32, 34 and 36. The bottom panel 58 includes a discharge spout assembly 62. Discharge spout assembly 62 is substantially identical to the discharge spout assembly 70 illustrated and described in U.S. Pat. No. 4,143,796, the disclosure of which is herein incorporated by reference.

FIG. 1 illustrates discharge spout assembly 62 in the closed position, while FIG. 5 illustrates the assembly in the open and extended position. Briefly, discharge spout assembly 62 includes a spout 64 connected to an opening in bottom panel 58. Spout 64 is closed with a wire tie 66. When not in use spout 64 can be rolled up, covered with flap 68, and closed inside assembly 70 by draw cord 72.

Collapsible receptacle 10 can be constructed of any suitably strong material which is flexible but substantially inextensible. Natural or synthetic woven material can be employed. Jute, cotton, polyethylene, or polypropylene are examples of such materials. It has been found that woven polypropylene material is advantageous because of its strength, durability and puncture resistance. An impermeable liner 74, shown in FIG. 1, can be provided inside receptacle 10, if desired. Liner 74 would be advantageous when handling footstuffs, fine powdered materials, or moist materials. Polybutylene film, for instance, can be used for liner 74.

Figure 6A:
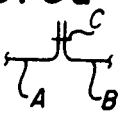
FIGS. 6*a*, 6*b*, 6*c* and 6*d* are diagrams of four types of seams utilized in constructing the invention.
Figure 6B:
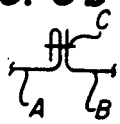
Figure 6C:
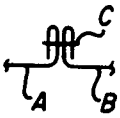
Figure 6D:
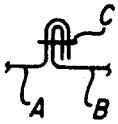

FIGS. 6*a*, 6*b*, 6*c* and 6*d* are detailed illustrations of seams which can be employed in connecting adjacent panels in receptacle 10. FIG. 6*a* comprises a plain seam wherein single layers of panels A and B are connected by stitching C. In FIG. 6*b* a double layer of panel A is secured to a single layer of panel B. Double layers of panels A and B are interconnected in FIGS. 6*c* and 6*d*. Panels A and B in these detailed illustrations represent any pair of adjacent panels in receptacle 10. If desired the outside edges of panels A and B can be fused or adhesively secured together to minimize leakage.

Figure 7:
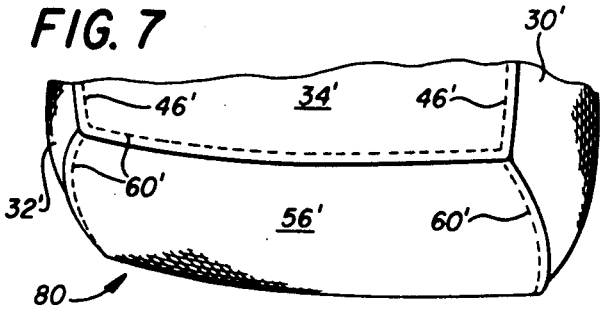
FIG. 7 is a partial bottom side perspective view of a collapsible receptacle incorporating a second embodiment of the invention.
Figure 8:
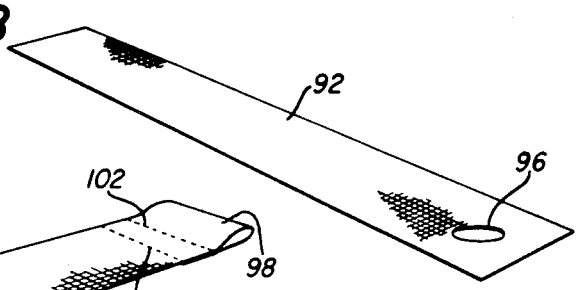
FIGS. 8–11 illustrate steps in constructing a third embodiment of the invention.
Figure 9:
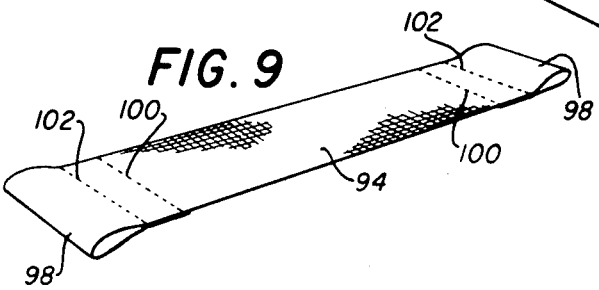

FIG. 7 partially illustrates a second embodiment of the invention. Various components of collapsible receptacle 80 are substantially identical in construction and function to components of collapsible receptacle 10 shown in FIGS. 1–5. Such identical components are designated in FIG. 7 with the same reference numerals, but are differentiated therefrom by means of a prime (′) designation.

The primary distinction comprises the fact that receptacle 80 does include a discharge spout assembly, whereas receptacle 80 does not include a discharge spout assembly, whereas receptacle 10 includes spout assembly 62. Bottom panel 58′ in receptacle 80 simply comprises a square or rectangular section of material. Discharge of flowable materials from receptacle 80 is accomplished by puncturing bottom panel 58′. Receptacle 80 is thus best suited for material handling applications wherein reuse of the receptacle is not contemplated. Though illustrated only partially, receptacle 80 is substantially identical to receptacle 10 in all other respects.

Figure 10:
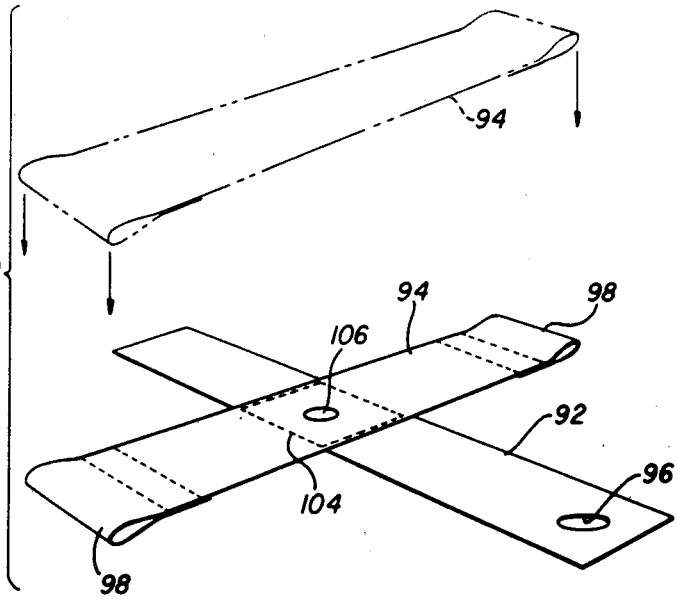
Figure 11:
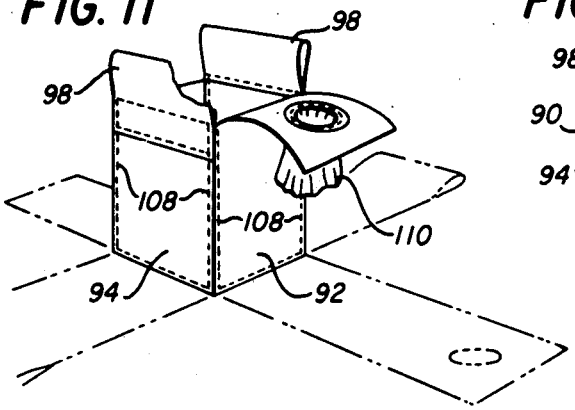
Figure 12:
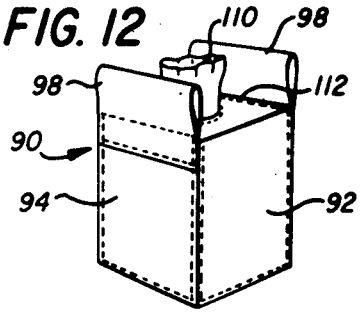
FIG. 12 is a perspective illustration of a collapsible receptacle incorporating the third embodiment of the invention.

FIGS. 8–11 illustrate the steps involved in constructing the collapsible receptacle 90 shown in FIG. 12. Receptacle 90 comprises a third embodiment of the present invention. Receptacle 90 is formed from two panels 92 and 94 each having the configuration of an elongate rectangle. Panels 92 and 94 comprise suitable natural or synthetic material, such as woven polypropylene or woven polyethylene. Panel 92 includes an opening 96 near one end thereof. Panel 94 includes loops or sleeves 98 formed at the ends thereof. Sleeves 98 in panel 94 are formed by folding back and securing the ends of the panel with stitching 100. Preferably, a second line of stitching 102 is provided between stitching 100 and the end of each sleeve 98.

As shown in FIG. 10, panel 94 is laid over panel 92 and secured thereto with stitching 104. The area where panels 92 and 94 cross over comprises the bottom of receptacle 90. If desired, an opening 106 can be formed through panels 92 and 94 to receive a discharge spout assembly. A discharge spout assembly similar to spout assembly 62 in receptacle 10 can then be mounted in bottom opening 106.

Panels 92 and 94 are folded inwardly and secured together along adjacent edges thereof by stitching 108, as is best shown in FIGS. 11 and 12. A fill spout 110 is then sewn into opening 96 in the upper portion of panel 92. This portion of panel 92 is then folded inwardly and secured about the periphery thereof by stitching 112 to the end panels 92 and 94. The top of receptacle 90 is thus closed in this manner. Any of the seam constructions illustrated in FIGS. 6*a*, 6*b*, 6*c* or 6*d* can be employed in constructing receptacle 90.

It will thus be apparent that collapsible receptacle 90 includes a bottom of double-layered construction. Receptacle 90 is comprised of two panels 92 and 94, each of which extends around the bottom of the receptacle for increased support. Lift sleeves 98 are connected by a continuous length of material uninterrupted by stitched seams.

Figure 13:
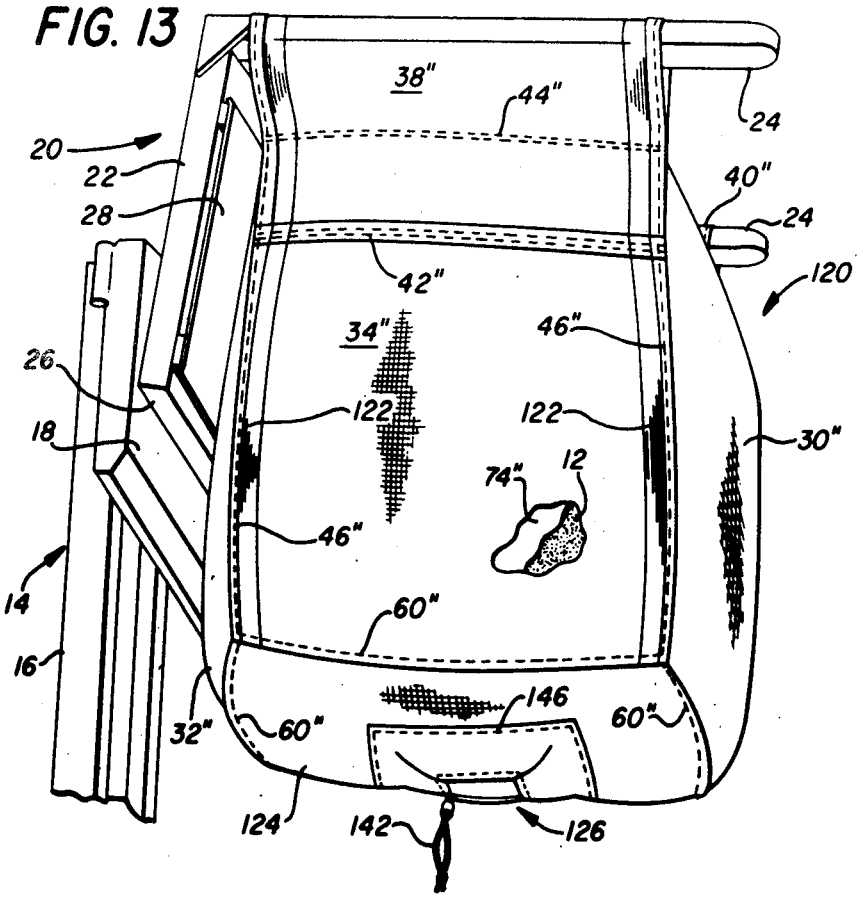
FIG. 13 is a bottom side perspective view of a collapsible receptacle incorporating a fourth embodiment of the invention.
Figure 14:
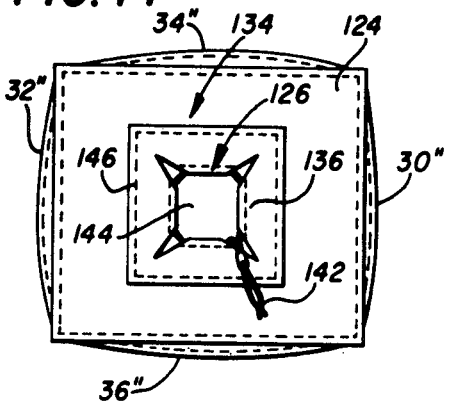
FIG. 14 is a bottom view of the receptacle shown in FIG. 13.
Figure 15:
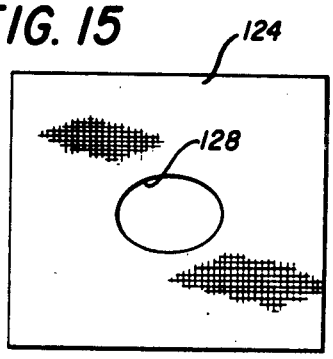

Referring now to FIG. 13, there is shown a collapsible receptacle 120 incorporating a fourth embodiment of the invention. Various components of the fourth inventive embodiment are substantially identical in construction and function to components of the first embodiment, receptacle 10 shown in FIGS. 1–5. These identical components are designated in FIG. 13 with same reference numerals as utilized hereinbefore in connection with receptacle 10, but are distinguished therefrom by means of a double prime (″) designation.

The primary distinction between receptacle 120 and receptacle 10 comprises bands 122 in panels 34″ and 36″, the latter of which is not shown in FIG. 13. Preferably, each panel 34″ and 36″ includes two longitudinal bands 122 extending the entire length thereof and positioned near each side edge thereof. Panels 34″ and 36″ are preferably formed of woven polypropylene or woven polyethylene material, while bands 122 are each formed of continuous strands woven straight into each panel. For example, each band 122 can be about one to two inches wide, and be comprised of about 50 strands of polyester. Bands 122 can also be woven into panels 34″ and 36″ in the form of selvage. It has been found that bands 122 in receptacle 120 further enhance the integral sling construction of the receptacle.

Referring to FIGS. 14–18, collapsible receptacle 120 preferably includes bottom panel 124 having discharge spout assembly 126 mounted therein. The bottom of receptacle 120 is constructed as follows. Panel 124 is provided with a central opening 128. A round or oblong configuration can be utilized for opening 128. In accordance with the preferred construction of the invention, opening 128 is generally oval or oblong in configuration. The longest dimension of opening 128 should be greater than the maximum bridging distance of the particular material 12 to avoid clogging of discharge spout assembly 126. It has been found that clogging or material bridging across an opening depends upon the width of the opening rather than area. An oval opening 128 is thus preferable because material bridging can be avoided with a relatively small opening which does not weaken panel 124 as much as a round or larger area opening.

Figure 16:
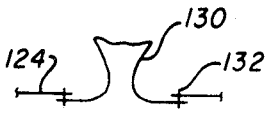

As shown in FIG. 16, a spout 130 is then secured in opening 128 by stitching 132. It will be appreciated that panel 124 with spout 130 could be utilized as the top panel 48" in receptacle 120.

Figure 17:
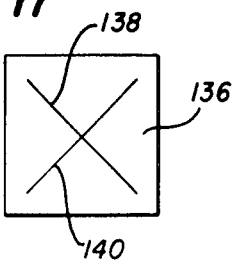
FIGS. 15–18 are detail illustrations showing construction of the bottom receptacle panel.
Figure 18:
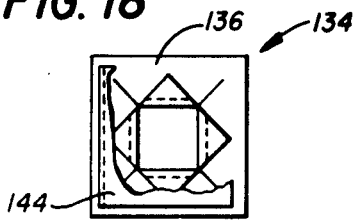

A closure subassembly 134, which is shown in FIGS. 17 and 18, is then secured over spout 130 to panel 124. Subassembly 134 includes another panel 136 which is relatively smaller than bottom panel 124. A pair of crosscuts 138 and 140 are formed through panel 136. Four flaps are thus formed by crosscuts 138 and 140. These flaps are next folded back and secured to panel 136, such as by means of sewing, to form guide loops for draw rope 142 shown in FIGS. 13 and 14. An optional cover flap 144 can then be sewn or otherwise secured to one side of panel 136 to complete construction of subassembly 134. The subassembly 134 is then attached to bottom panel 124 with stitching 146 to complete construction of discharge spout assembly 126.

It will be understood that the construction of panel 124 and discharge spout assembly 126 comprises a significant feature of the invention. This construction is not limited to receptacle 120, but can be employed in receptacle 10 or other receptacle constructions. The construction of this bottom panel begins with a panel/spout subassembly, which can be utilized by itself as a top panel. A bottom panel is formed simply by adding a closure subassembly 134 to panel 124. This facilitates the construction of both top and bottom panels. In addition, the use of subassembly 134 considerably reinforces panel 124 in the area surrounding spout 130 by eliminating high stress points at the corners of crosscuts 138 and 140.

Figure 21:
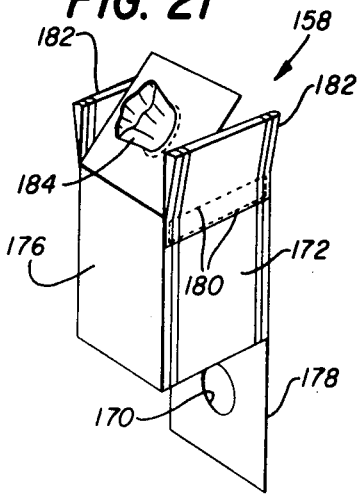
Figure 22:
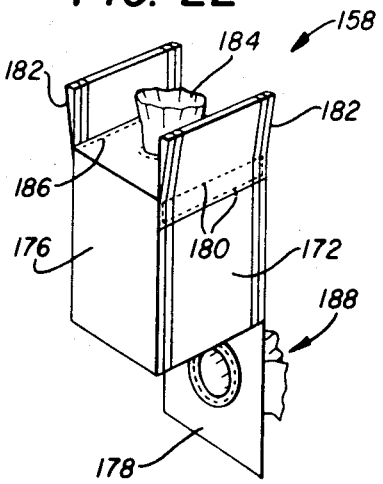
Figure 23:
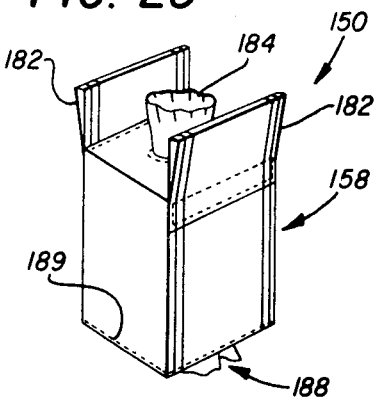
FIG. 23 is a perspective illustration of a collapsible receptacle incorporating the fifth embodiment of the invention.

FIGS. 19–22 illustrate the steps involved in constructing the collapsible receptacle 150 shown in FIG. 23. Receptacle 150 comprises a fifth embodiment of the invention herein. In contrast to the collapsible receptacles or receptacles shown in FIGS. 1–18, each of which is constructed from multiple pieces of suitable rectangular material, the receptacle 150 is constructed from a single piece of material. The method of constructing receptacle 150 can be adapted to automation and comprises a significant feature of this particular embodiment.

Figure 19:
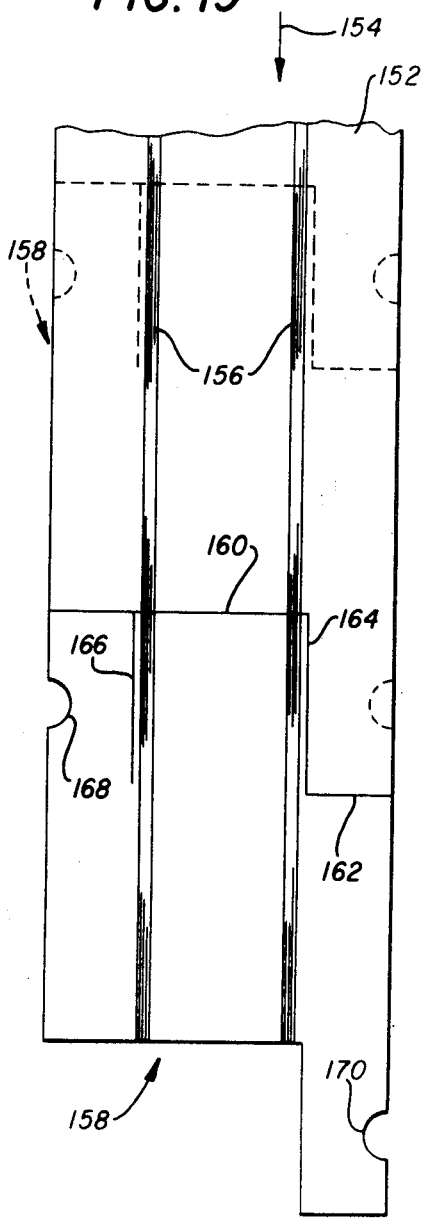
FIGS. 19–22 illustrate steps in constructing a fifth embodiment of the invention.

Referring to FIG. 19, a predetermined receptacle blank is first cut from a length of circular or tubular material 152. Suitable natural or synthetic material, such as woven polypropylene or woven polyethylene, can be used for material 152. Circular or tubular material 152 is in flattened condition and advanced from a supply thereof in the direction of arrow 154 into a cutting station. If desired, material 152 can include four integral reinforcing bands 156, only two of which are shown. Bands 156 are similar to bands 122 utilized in receptacle 120 described above. Each band 156, for example, comprises an area of one to two inch width with a plurality of continuous reinforcing strands extending in a longitudinal direction through material 152. Provision of bands 156 in material 152 enhances the integral sling construction of receptacle 150.

Receptacle blank 158 is cut from material 152 as follows. One transverse cut 160 extends inwardly from one edge of material 152 and across about $\frac{3}{4}$ of the width thereof. Another transverse cut 162 is made inwardly from the opposite edge of material 152 offset from cut 160 and across the remaining $\frac{1}{4}$ width of material 152. The ends of cuts 160 and 162 are connected by a longitudinal cut 164. Another longitudinal cut 166 intersects cut 160 at a point located at $\frac{1}{4}$ of the width of material 152 from the opposite edge thereof. Cuts 160, 162, 164 and 166 all extend through both layers of the flattened circular or tubular material 152.

It will be apparent that cut 166 remains in receptacle blank 158, while cuts 160–164 serve the purpose of severing the receptacle blank from material 152. Cuts 160, 162 and 164 define the upper end of the leading receptacle blank 158, and at the same time define the bottom end of the trailing receptacle blank. There is thus little or no material waste in forming each receptacle blank 158, which is one of the significant advantages of the fifth inventive embodiment herein.

In accordance with the preferred construction, two openings are then cut into the opposite longitudinal edges of receptacle blank 158. A generally semi-circular fill opening 168 is formed in the edge of receptacle blank 158 near cut 166. A generally semi-circular discharge opening 170 is preferably formed in the opposite edge of receptacle blank 158 at the bottom end thereof. Provision or opening 170 is optional and is not necessary if it is desired to construct receptacle 150 without a discharge spout.

Figure 20:
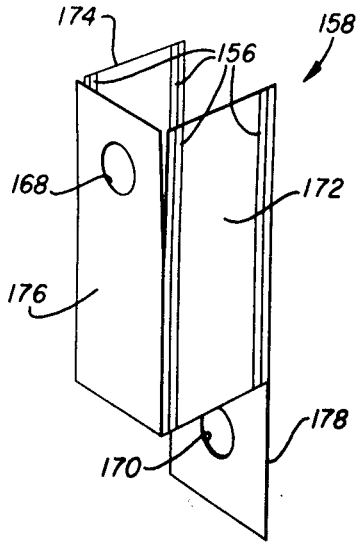

The tubular receptacle blank 158 is then opened as shown in FIG. 20. It will be observed that a pair of reinforcing bands 156 are provided in opposite panel portions 172 and 174 of the receptacle blank 158, while openings 168 and 170 are provided in the remaining pair of panel portions 176 and 178 thereof.

Referring to FIG. 21, the upper ends of panel portions 172 and 174 are then folded back and secured to themselves with at least one line of stitching 180 to form lift loops or sleeves 182. After formation of lift sleeves 182, a fill spout 184 is then sewn into opening 168 of panel portion 176 in receptacle blank 158. Installation of fill spout 184 is similar to that of spout 52 shown in FIG. 4.

Referring to FIG. 22, the top end of panel portion 176 with fill spout 184 therein is folded inwardly and secured about the periphery thereof by stitching 186 to panel portions 172 and 174. Closure of the top end of receptacle 150 is thus completed with this step. A conventional wire tie (not shown) can be used to close fill spout 184.

Referring to FIGS. 22 and 23, a discharge spout assembly 188 is next sewn into opening 170 in the lower ends of panel portion 178. If desired, discharge spout assembly 188 can comprise simply a spout 190 and wire tie 192 installed in a fashion similar to fill spout 184.

Figure 24:
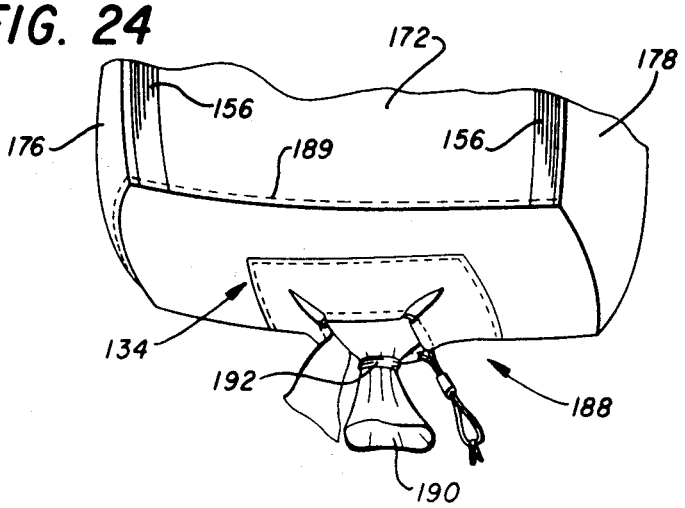
FIG. 24 is a partial perspective view of the receptacle shown in FIG. 23 with the discharge spout assembly extended.
Figure 25:
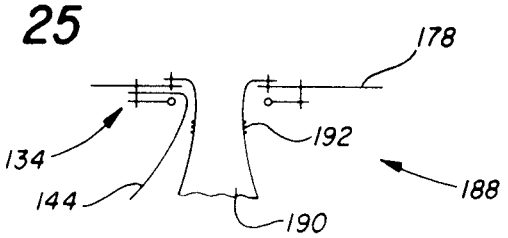
FIG. 25 is a diagrammatic vertical section view through the extended discharge spout assembly of FIG. 24.
Figure 26:
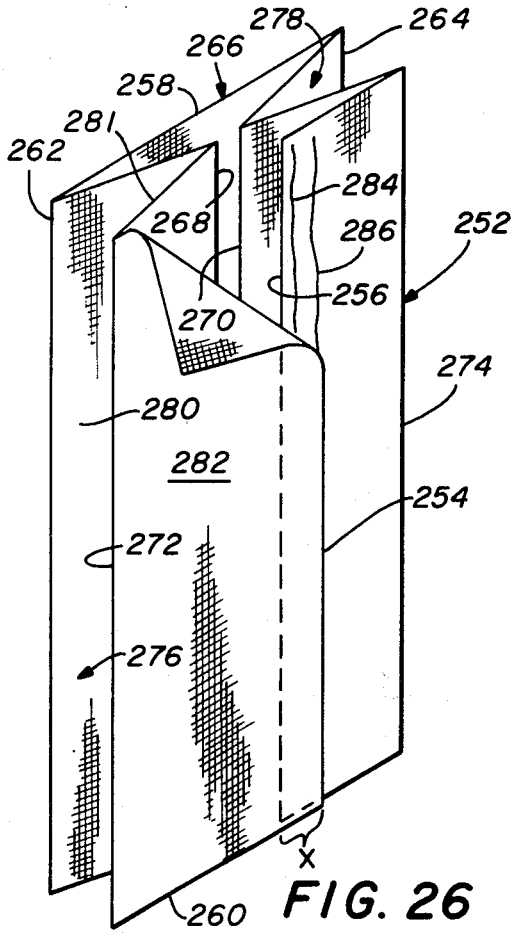
FIG. 26 is a top side perspective view of a collapsible receptacle incorporating a sixth embodiment of the invention.
Figure 27:
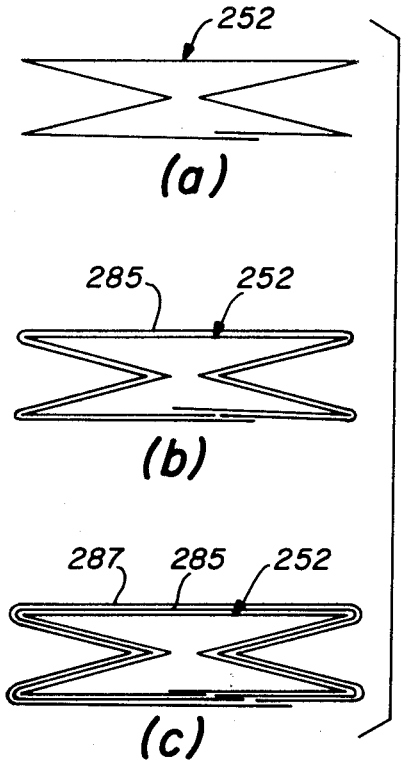
FIGS. 27*a*, 27*b* and 27*c* are top views of the collapsible receptacle shown in FIG. 26 formed of different numbers of layers of material.

FIGS. 24 and 25 illustrate the preferred construction of discharge spout assembly 188 in the open and extended position. A closure subassembly 134, which was previously described herein and shown in FIGS. 17 and 18, is secured to panel portion 178 around spout 190. The addition of closure subassembly 134 reinforces the bottom of receptacle 150.

Figure 35:
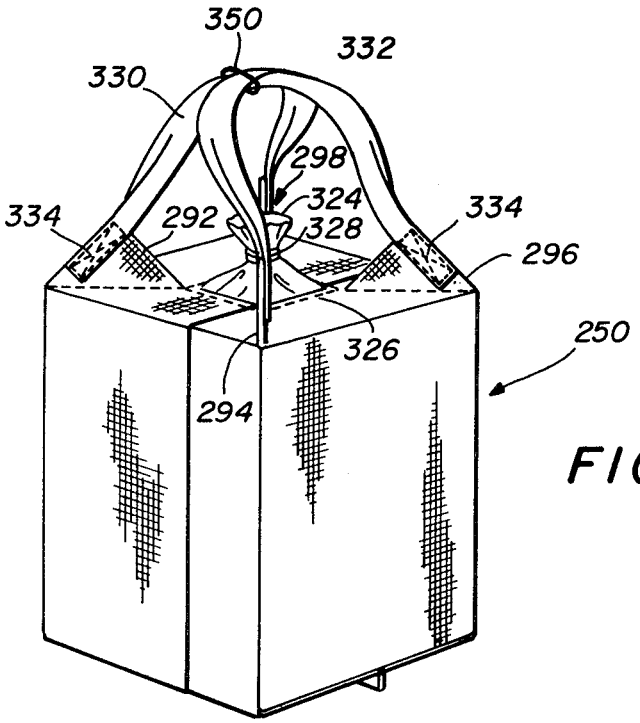
FIG. 35 is a top side perspective view of the collapsible receptacle of the sixth embodiment with carrying straps.

FIG. 35 illustrates a collapsible receptacle 250 incorporating a sixth embodiment of the invention. The receptacle 250 is formed of a flexible, collapsible construction and is also useful in handling semi-bulk quantities of material.

Constructional details of the receptacle 250 are shown in FIGS. 26–34. The receptacle 250 includes a sheet 252 of a flexible, yet unexpandable, material. Natural or synthetic woven material can be employed. Jute, cotton, polyethylene or polypropylene are examples of such materials. It has been found the woven polypropylene and polyethylene materials are advantageous because of their strength, durability and puncture resistance.

In the preferred construction, the sheet 252 is formed in a rectangular shape having side edges 254 and 256, a top edge 258 and a bottom edge 260. The sheet 252 is folded along first fold lines 262 and 264 to define a first side panel 266 between the first folds and top and bottom edges 258 and 260.

Second folds 268 and 270 and third folds 272 and 274 are made in sheet 252 on either side of the first folds from the first side panel 266. The second and third folds define second and third side panels 276 and 278. Each side panel is formed of a panel half 280 and 281.

The side edges 254 and 256 are overlapped a distance X and secured together to form a fourth side panel 281. In the preferred construction, two glue lines are provided between the side edges. The glue line 284 is a hot melt glue for immediate adhesion between the side edges 254 and 256. The second glue line 286 is non-heated adhesive having a slower setting period than the glue in line 284 but having a greater final adhesion strength. The glue line 284 permits a rapid bond to be formed between the side edges 254 and 256 during construction of the receptacle 250 and maintains the position of the side edges permitting the glue on line 286 to properly set.

In a particular application, it may be desirable to increase the thickness of the side panels in the receptacle 250. This can of course be accomplished by increasing the thickness of the sheet 252. Alternatively, multiple sheets may be folded in a manner similar to sheet 252 to form multi-layered side panels in the receptacle 250. FIG. 27*a* illustrates a top view of the sheet 252 folded as herein described. FIG. 27*b* illustrates sheets 252 and 285 folded in an identical manner to form double layered side panels in the receptacle 250. The folds for the panels 252 and 285 are preferably offset so that the glue line between the side edges of each sheet is offset. Therefore, local stresses caused by material within the receptacle will never act directly on more than one glue line in the receptacle. FIG. 27*c* illustrates the use of sheets 252, 285 and 287 interfolded to form a triple layered side panel in the receptacle 250. Again, the glue lines between the side edges of each sheet is preferably offset. If desired, one or more sheets 252, 285 or 287 can be of a material impervious to the material stored in receptacle 250.

The next step in the formation of the receptacle 250 is the fastening together of adjacent panels at the first and third folds. In the preferred construction, this is accomplished by corner sew lines 288. The corner sew line extend from the first and third folds upwardly and inwardly to the top edge 258 of the sheet 252. The corner sew lines 288 define flaps 290, 292, 294 and 296. The flaps are formed of a double thickness of the material of sheet 252.

Figure 29:
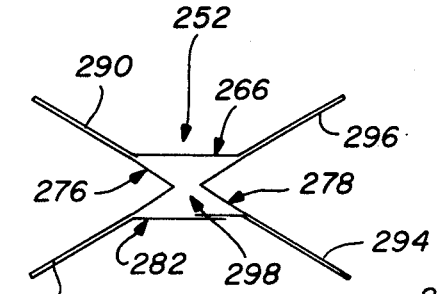
FIG. 29 is a top view of the collapsible receptacle incorporating the sixth embodiment of the invention.
Figure 30:
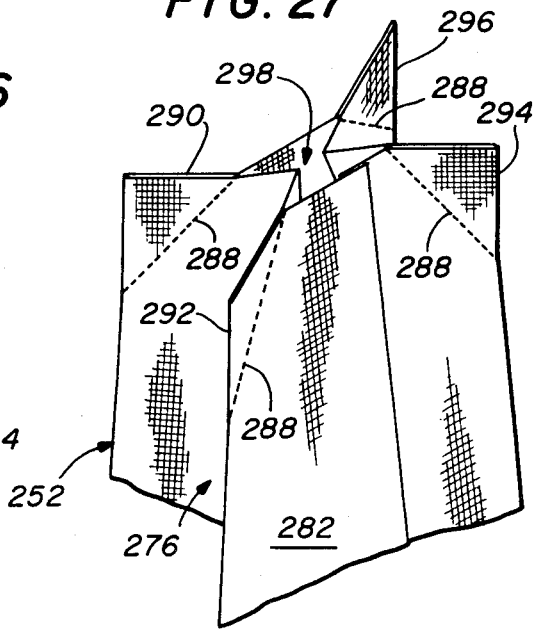
FIG. 30 is a top side perspective view of another step in constructing the sixth embodiment of the invention.
Figure 28:
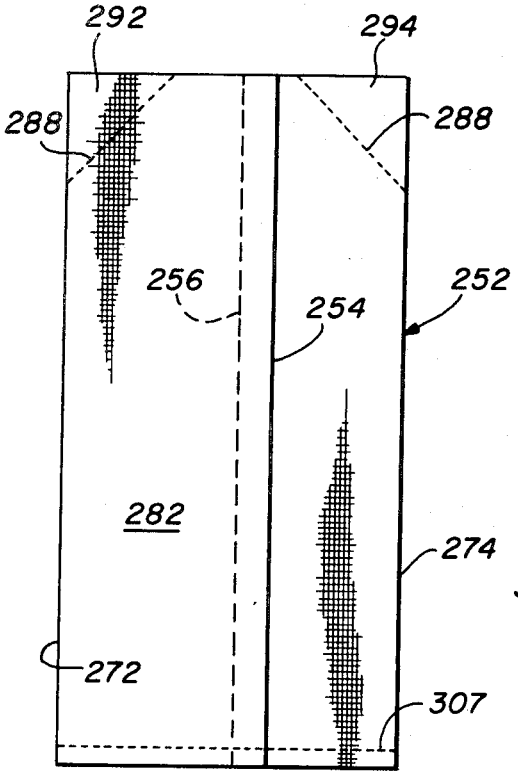
FIG. 28 illustrates in a side view a step in constructing the collapsible receptacle incorporating the sixth embodiment.
Figure 31:
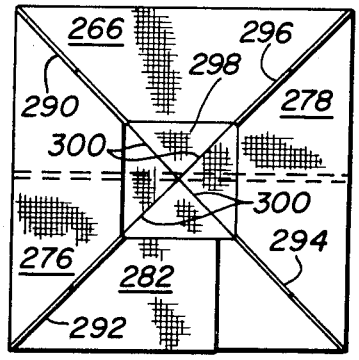
FIG. 31 is a top view of the collapsible receptacle incorporating the sixth embodiment.
Figure 33:
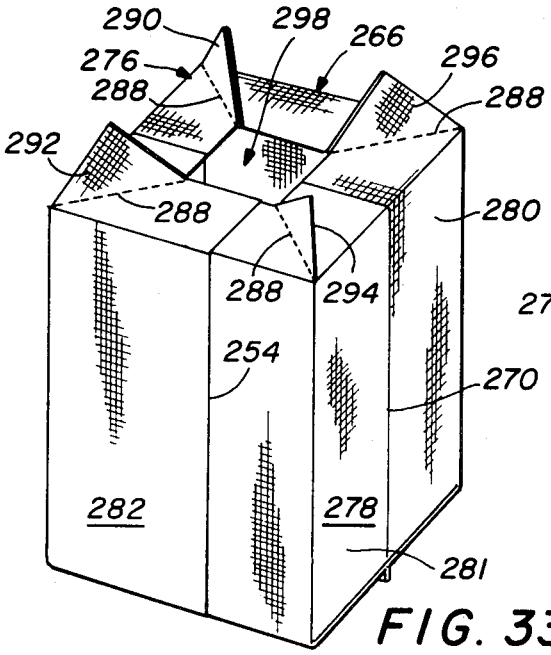
FIG. 33 is a top side perspective view of the sixth embodiment of the invention.

The sheet 252 with sew lines 288 may still be retained in a flattened form for storage as illustrated in FIG. 28. When the sheet is expanded as shown in FIGS. 29 and 30, a top opening 298 is formed. When fully expanded, the sheet 252 forms a square opening 298 as illustrated in FIGS. 31 and 33.

Figure 32:
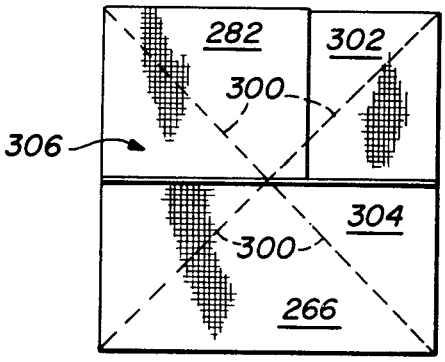
FIG. 32 is a bottom view of one form of bottom used with the sixth embodiment.

The next step in construction is the formation of a bottom to container 250. In one construction illustrated in FIG. 32 solds 300 are made on opposed side panels 276 and 278 extending from the bottom edge 260 near the center of the panel upward to intersect the second and thirds folds between the side panels. This forms square bottom panels 302 and 304 as shown in FIG. 32 formed from material from the adjacent side panels 266 and 282. The bottom panels may then be folded to form a flat bottom 306. The bottom 306 may be maintained by gluing the bottom panels to the folded material in the opposite side panels. Another suitable bottom is formed by serving the side panels together along the bottom edge 260 by stitching 307 as seen in FIG. 28. Stitching 307 secures panels 266, 282 and panel halves 280 and 282 in facing relation.

In another embodiment, a separate bottom panel 308 may close the lower end of the container 250. The panel 308 is substantially identical to panel 58 discussed hereinabove. The bottom panel 308 is secured about the periphery of the bottom edge 260 by stitching 310 at the bottom edges of side panels 266, 276, 278 and 282. A discharge spout assembly 312 may be positioned in the bottom panel 308. The spout assembly 312 is substantially identical to discharge spout assembly 62 described hereinabove, which in turn is substantially identical to the discharge spout assembly 70 illustrated and described in U.S. Pat. No. 4,143,796, the disclosure of which is herein incorporated by reference. Briefly, the spout assembly 312 includes a spout connected to an opening in the bottom panel 308. The spout may be closed with a wire tie. When not in use, the spout can be rolled up, covered with a flap and closed inside flaps 320 by drawcord 322.

A fill spout 324 is mounted in the opening 298 as shown in FIG. 35. The spout 324 is generally cylindrical, and is secured by stitching 326 about the circumference of the opening 298. A wire tie 328 or other suitable device can be employed to close the fill spout 324.

To lift the receptacle 250, diagonal lifting straps 330 and 332 are provided. The ends of diagonal lifting strap 330 are secured to flaps 296 and 292, respectively. The strap is secured by gluing 334. However, glue may be used to attach the strap to the flaps, or, in combination stitching and glue.

The diagonal lifting strap 332 is similarly secured at its ends to flaps 290 and 294, respectively. Stitching 334 (not shown) is also employed to secure the strap to the flaps. Again, glue or combination glue and stitching may be used if desired.

It is apparent from FIG. 35 that the diagonal lifting straps 330 and 332 provide an effective way to lift the receptacle 250. The straps are secured to the flaps which have a double layered thickness of material for added strength. The diagonal attachment would permit the receptacle to be lifted by a single strap alone if desired. The flaps stand upright, urging the lifting straps upward for easy insertion of a forklift or other lifting device under the straps. A loop 350 is provided about the straps to insure that both straps are employed in lifting the receptacle.

Figure 36:
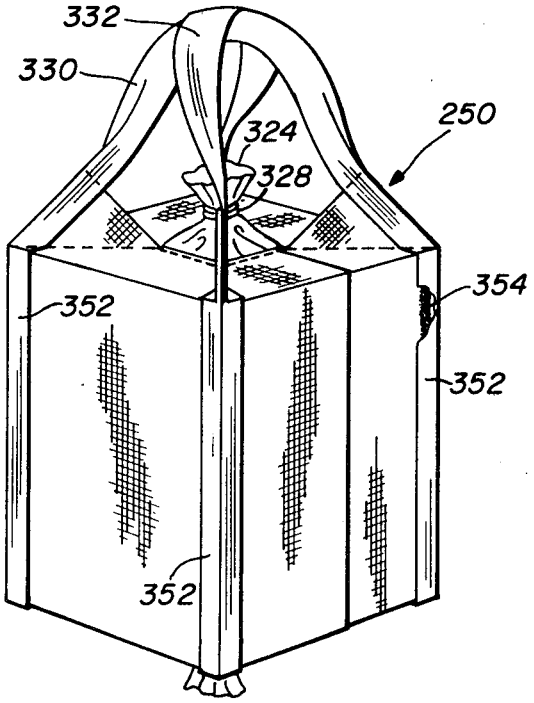
FIG. 36 is a top side view of the collapsible receptacle of the sixth embodiment having reinforcing material.

Reinforcing bands 352 can be used as illustrated in FIG. 36. The bands 352 are secured along both the side panels at each of the first and third folds by gluing 354. In the receptacle illustrated in FIG. 36, the reinforcing bands 352 are formed integral with the diagonal lifting straps 330 and 332. The bands 352 are folded over the flaps and glued onto both sides of the flaps. However, separate reinforcing bands and straps can be used with the upper ends of the bands being secured to the lifting straps and flaps by stitching or other suitable fastening. In the preferred construction, the materials forming sheet 252 and reinforcing bands 352 are the same, or have similar elasticity. This will reduce the shear forces on the gluing 354 or other securing material when the receptacle is lifted.

From the foregoing, it will be understood that the present invention as embodied in receptacle 250 comprises an improved collapsible receptacle having numerous advantages over the prior art. The receptacle 250 is easily flattenable for storage and transport. The steps in manufacture may readily be automated with no complex or intricate stitching being necessary. The flaps formed by the stitching to form the top of the receptacle form effective structure for lifting the receptacle. The glued side seams have been found to be much stronger than conventional sewed side seams in drop tests.

In one test, a sewed side seam flexible receptacle was found to withstand only about a 30" drop. The receptacle was a single wall sewn seam receptacle using four vertical panels of 6.5 square yards of fabric with a nominal fill strength of 275 pounds per inch. The receptacle held a 2200 pound load during the test. The work absorbed by the sewn sack is estimated to be 5500 foot pounds.

A receptacle incorporating a glued seam with the same nominal 275 pound per inch fabric and size has been found to take at least four drops of four feet with the same load. The work absorbed by the glued seam is 35,200 foot pounds, or more than six times that of the sewn seam. While the sewn seam and glued seam have about the same pull strength, the glued seam is much stronger during the drop test. This can be attributed to the far better distribution of impact load in the fabric by the glued seam.

FIGS. 37–41 illustrate an alternative method of attaching lifting loops to a collapsible receptacle of the types described hereinabove in connection with FIGS. 1–36. The use of the procedures shown in FIGS. 37–41 results in improved strength and greater resistance to damage to the receptacle resulting either from excessive loading or excessive mechanical shock.

Figure 37:
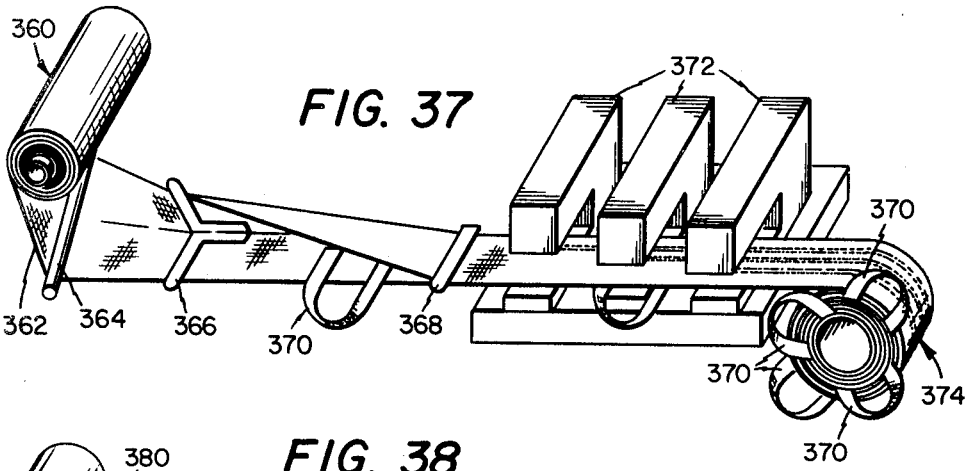
FIG. 37 is a schematic illustration of a first method of securing lift loops to a length of fabric material.

Referring particularly to FIG. 37, a roll 360 comprises a length of flexible, yet unextensible, material 362. Jute, cotton, polyethylene or polypropylene are examples of such materials. It has been found that woven polypropylene and woven polyethylene materials are advantageous because of their strength, durability and puncture resistance.

The length of material 362 is initially folded to provide a double layer of material. Although any conventional technique may be used to fold the length of material 362, and inclined roller 364, a fixture 366 and a fixture 368 can advantageously be used for this purpose. Lift loops 370 are inserted between the two layers comprising the folded length of material 362 at predetermined intervals. The lift loops 370 preferably comprise U-shaped lengths of webbing of the type used in automobile seat belts and similar applications. Nylon, cotton, and similar materials may be used to weave the webbing which is used to form the lift loops 370.

An important feature of the present invention involves the fact that in positioning the lift loops 370 between the layers comprising the folded length of material 362, a gap or spacing is maintained between the two ends defining the U-shaped configuration of each lift loop 370 and the fold of the length of material 362. For example, in the practice of the invention it has been found advantageous to maintain a gap or spacing of approximately two (2) inches between the ends of the lift loops 370 and the fold of the length of material 362.

The following the insertion of the lift loops 370 and the completion of the fold, the folded length of material 362 having the lift loops 370 inserted between the layers thereof at predetermined intervals passes through a series of sewing machines 372. Although the use of three sewing machines 372 is illustrated in FIG. 37, it will be understood that the particular number of sewing machines used is not critical to the practice of the invention. Thus, in situations in which each sewing machine has only a single sewing needle it may be necessary to employ as many as 6 or 8 sewing machines. Conversely, if a sewing machine having up to 8 sewing needles is provided then the invention may be practiced utilizing a single sewing machine.

The sewing procedure serves to simultaneously secure the two layers comprising the length of material 362 one to the other, and also secures the left loops 370 therebetween. The completed subassembly comprising the folded layers of the length of material 362 with the lift loops 370 secured therebetween is then wound onto a roll 374 with the loops 370 projecting from one end of the roll 374.

Figure 38:
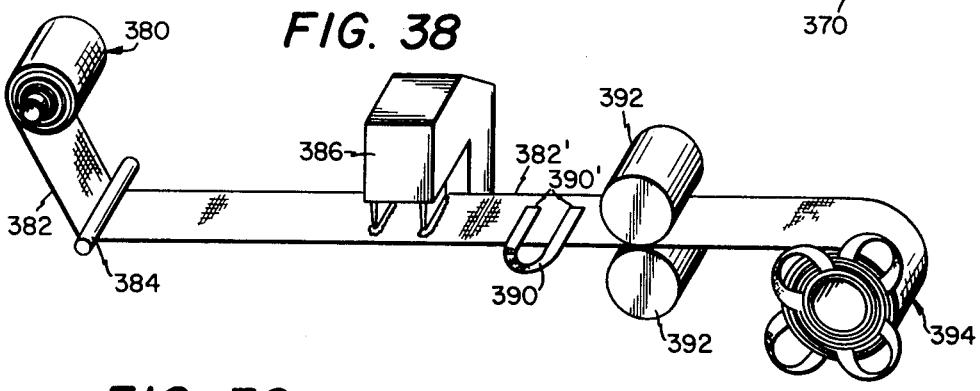
FIG. 38 is a schematic illustration of a second method of securing lift loops to a length of fabric material.

An alternative method of securing lift loops to a length of material is illustrated in FIG. 38. A roll 380 comprises a length of material 382 which preferably comprises a flexible, yet nonexpandable material. Natural or synthetic woven material may be employed. Jute, cotton, polyethylene or polypropylene are examples of such materials. It has been found that woven polypropylene or woven polyethylene materials are advantageous because of their strength, durability and puncture resistance.

The length of material 382 is approximately half as wide as the length of material 362 as shown in FIG. 37. The length of material 382 passes under a roller 384 and then through a mechanism 386 which applies adhesive to the surface of the length of material 382.

Lift loops 390 are then applied to the adhesive coated length of material 382. The lift loops 390 are preferably formed from webbing of the type utilized in automotive seat belts and similar applications. The webbing used to form the lift loops 390 may be formed from nylon, cotton, or similar materials.

The lift loops 390 are applied to the length of material 382 with the ends thereof defining the U-shaped configuration in a spaced apart relationship with respect to the adjacent edge of the length of material 382. That is, a gap or spacing is provided between the ends 390' of each lift loop 390 and the adjacent edge 382' of the length of material 382. In the practice of the invention a gap or spacing of approximately two (2) inches between the ends 390' of the lift loops 390 and the edge 382' of the length of material 382 has been found to be satisfactory.

Following positioning of the lift loops 390 thereon the length of material 382 passes between a pair of pinch rollers 392. The pinch rollers 392 function to securely engage the lift loops 390 with the adhesively coated surface of length of materials 382. After passing between the pinch rollers 392 the length of material 382 with the lift loops 390 adhesively secured thereto is wound upon a roll 394.

Figure 39:
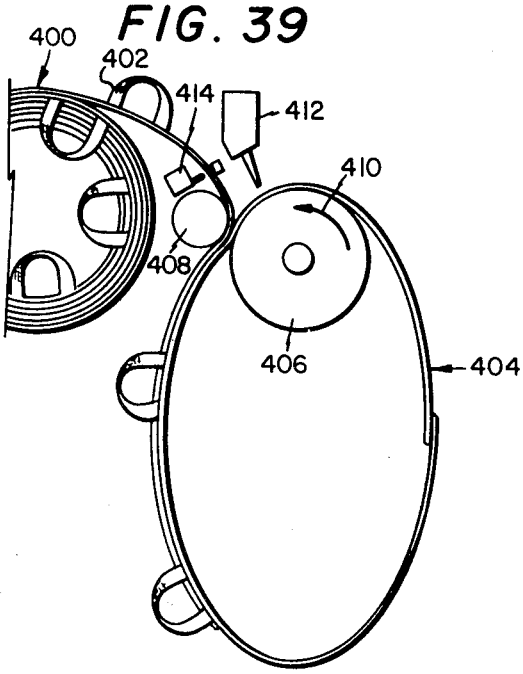
FIG. 39 is a schematic illustration of a method of adhesively securing a length of fabric material having lift loops previously secured thereto to a collapsible receptacle body panel.

Referring to FIG. 39, the construction of a collapsible receptacle by means of a length of material 400 having lift loops 402 secured thereto is shown. The subassembly comprising the length of material 400 having lift loops 402 secured thereto may be formed either by means of the technique illustrated in FIG. 37 or by means of the technique illustrated in FIG. 38.

A semifinished collapsible receptacle 404 is mounted on a platen 406. The receptacle 404 is preferably similar to the receptacle 250 illustrated in FIGS. 26–36. However, in accordance with the embodiment of FIG. 39 it is not necessary to provide folds in the semifinished receptacle 404.

A pinch roller 408 is used to secure the receptacle 404 in engagement with the platen 406. Upon rotation of the platen 406 in the direction indicated by the arrow 410, an adhesive applicator 412 is employed to deposit a layer of adhesive on the receptacle 404. As the leading edge of the layer of adhesive moves into the gap between the platen 406 and the pinch roller 408 the leading edge of the length of material 400 is simultaneously fed into the same gap. By this means the length of material 400 having the lift loops 402 secured thereto comes into engagement with the adhesive layer and is securely bonded to the receptacle 404 by means of the pressure exerted between the pinch roller 408 and the platen 406.

The application of adhesive by means of the applicator 412 and the simultaneous advance of the receptacle 404 by means of the platen 406 continues until the receptacle 404 has made a complete revolution. At that time a knife 414 is actuated to sever the length of material 400. Rotation of the platen 406 continues until the trailing edge of the length of material 400 has been adhesively secured to the receptacle 404. If desired, some overlap may be provided between the leading edge of the length of material 400 which is initially secured to the receptacle 404 and the trailing edge of the length of material 400 which is finally secured to the receptacle 404.

Figure 4:
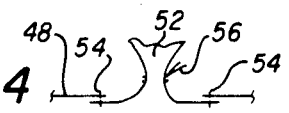
FIG. 4 is a diagrammatic sectional view taken along lines 4—4 of FIG. 3 in the direction of the arrows.
Figure 34:
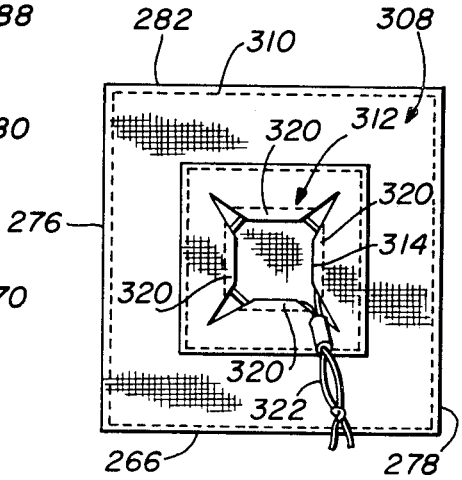
FIG. 34 is a bottom view of another bottom for use with the sixth embodiment.

The receptacle 404 is completed by securing top and bottom panels thereto. The top panel may be formed as shown in FIGS. 2, 3 and 4 and as described hereinabove in connection therewith. The bottom panel may be formed as shown in FIGS. 24 and 25 and as described hereinabove in connection therewith. Alternatively, the bottom panel may be formed as shown in FIG. 34 and as described hereinbefore in connection therewith.

Figure 40:
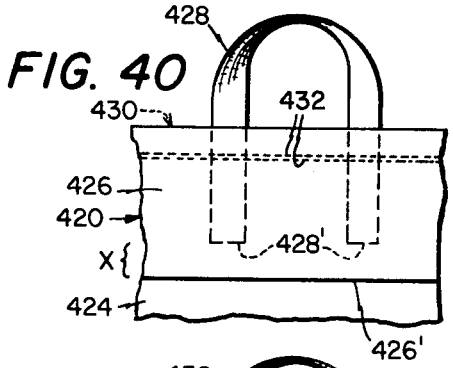
FIG. 40 is an illustration of a collapsible receptacle made in accordance with FIGS. 37 and 39.
Figure 41:
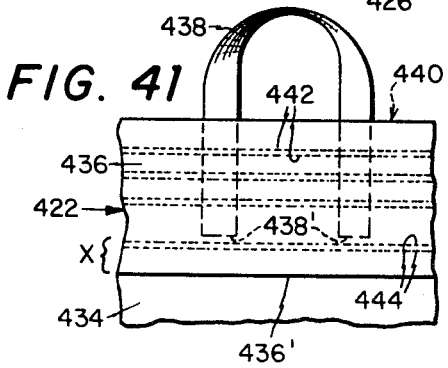
FIG. 41 is an illustration of a collapsible receptacle made in accordance with FIGS. 38 and 39.

Referring now to FIGS. 40 and 41, collapsible receptacles 420 and 422 formed in accordance with the present invention are illustrated. Since the receptacles 420 and 422 are similar in many respects to those illustrated in FIGS. 1, 2, 13, 35 and 36, only the upper portions of the receptacles 420 and 422 are shown in FIGS. 40 and 41, respectively.

Receptacle 420 comprises a body 424 having a fabric strip 426 and lift loops 428 secured thereto. The receptacle 420 is formed by first securing the lift loops 428 to the fabric strip 426 in accordance with the procedure of FIG. 38, and then securing the fabric strip 426 having the lift loops 428 previously secured thereto to the body 424 in accordance with the procedure of FIG. 39. The receptacle 420 further includes a bottom panel which is not shown but which may be similar to the bottom panel illustrated in FIGS. 24 and 25 and described in conjunction therewith, and a top panel 430 which may be similar to the top panel shown in FIGS. 3 and 4 and described in conjunction therewith. The top panel is secured to the body 424, the fabric strips 426 and the lift loops 428 by means of stitching 432.

The receptacle 422 comprises a body 434 having a fabric strip 436 and lift loops 438 secured thereto. In the construction of the receptacle 422 the lift loops 438 are first secured to the fabric strip 436 in accordance with the procedure of FIG. 37. Thereafter the fabric strip 436 having the lift loops 438 secured thereto is adhesively secured to the body 434 in accordance with the procedure of FIG. 39. The receptacle 422 further includes a bottom panel which is not shown but which may be similar to the bottom panel shown in FIGS. 24 and 25 and described in conjunction therewith, and a top panel 440 which may be similar to the top panel shown in FIGS. 3 and 4 and described in conjunction therewith. The top panel 440 is secured to the body 434, the fabric strip 436 and the lift loops 438 by blinds of stitching 442.

In addition to being adhesively bonded to the body 434, the fabric strip 436 is secured thereto by double lines of stitching 444. Such double lines of stitching 444 may also be used to further secure the strip 426 to the body 424 of the receptacle 420, if desired.

As is clearly shown in FIG. 40, the ends 428′ of the lift loops 428 are separated by a distance X from the lower edge 426′ of the fabric strip 426. Similarly, the lower ends 438′ of the lift loops 438 are separated by a distance X from the lower edge 436′ of the fabric strip 436 of the receptacle 422. Such separation between the lower ends of the lift loops and the lower edge of the fabric strip comprises an important feature of the present invention. By this means any stress concentration that might otherwise occur when the lift loops are used to lift the receptacle is eliminated. Instead, the lifting force is transmitted from the lift loops into the adhesive layer which secures the lift loops and the overlying fabric strip to the body of the container and hence into the receptacle body with no undue stress concentrations occurring. This prevents both possible separation of the lift loops from the receptacle and possible tearing of the receptacle at the point of attachment of the lift loops thereto.

Figure 42:
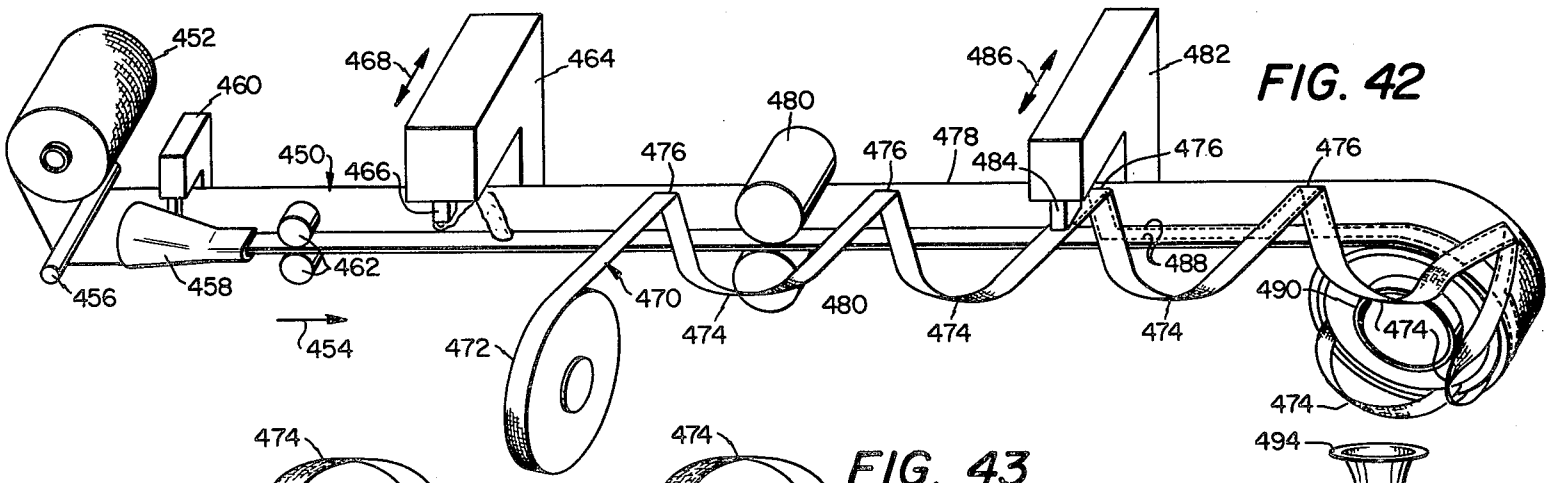
FIG. 42 is a schematic illustration of a third method of securing lift loops to a length of a fabric material.

Referring now to FIG. 42, yet another embodiment of the invention is shown. A length of fabric material 450 is received from a roll 452 and travels in the direction of an arrow 454. A length of fabric material 450 may comprise various natural and synthetic materials fabricated utilizing various conventional techniques. Preferably, the length of fabric material 450 comprises woven fabric material formed from either polypropylene or polyethylene or both.

The length of fabric material 450 travels from the roll 452 around a roller 456 and then through a folding assembly 458 which folds one edge of the length of fabric material inwardly. An adhesive application mechanism 460 deposits adhesive between the two layers of the folded edge of the length of fabric material 450 prior to engagement therebetween. The folded edge of the length of fabric material 450 then passes between the pair of pinch rollers 462 which function to force the two layers comprising the folded edge into intimate contact with the adhesive, thereby assuring a strong bond.

The length of fabric material 450 next passes through an adhesive application mechanism 464. The adhesive application mechanism 464 has an adhesive depositing head 466 which travels in the direction indicated by the arrow 468 at the same time the length of fabric material 450 is traveling in the direction indicated by the arrow 454. By this means the adhesive application mechanism 464 is caused to deposit V-shaped patterns of adhesive at spaced intervals along the length of fabric material 450.

A length of webbing material 470 is supplied from a roll 472. Various natural and synthetic materials may be utilized in forming the length of webbing material 470.

However, in the preferred embodiment of the invention the length of webbing material 470 is fabricated from polyester or nylon.

The length of webbing material 470 is positioned on the length of fabric material 450 so as to overlay each V-shaped pattern of adhesive as deposited by the adhesive application mechanism 464. As is clearly shown in FIG. 42, this causes the length of webbing material 470 to be secured to the length of fabric material 450 in a series of loops 474. In each loop 474 the length of webbing material 470 is twisted one half turn. At each point of attachment to the length of fabric material 450 the length of webbing material 470 is folded back upon itself to define a series of V-shaped folds 476 each positioned a predetermined distance from the adjacent edge 478 of the length of fabric material 450.

The length of fabric material 450 with the loops 474 comprising the length of webbing material 470 positioned thereon next passes between a pair of pinch rollers 480. Rollers 480 force the length of fabric material 450 and the length of webbing material 470 into intimate contact with the adhesive therebetween, thereby assuring a strong adhesive bond between the length of webbing material 470 and the length of fabric material 450.

The length of fabric material 450 with the loops 474 secured thereto next passes through a sewing machine 482. The sewing machine 482 has a sewing head 484 which moves in the direction indicated by the arrow 486 as the length of fabric material moves in the direction indicated by the arrow 454. The movement of the sewing head 484 is coordinated so that lines of stitching 488 are formed first along the folded edge of the length of fabric material 450, and then along the length of webbing material 470 at its point of attachment to the length of fabric material 450, and then along the folded edge of the length of fabric material, etc. The sewing head may also be supported for rotational or pivotal movement about a vertical axis so as to maintain a predetermined spacing between the lines of stitching 488, or two or more separate sewing machines may be employed to form the lines of stitching 488.

It will thus be understood that the loops 474 and the folds 476 comprising the length of webbing material 470 are secured to the length of fabric material both adhesively and by sewing. Upon completion of the sewing step the length of fabric material is wound onto a reel 490. As the length of fabric material 450 is wound onto the reel 490 the loops 474 project outwardly from one end thereof.

Figure 43:
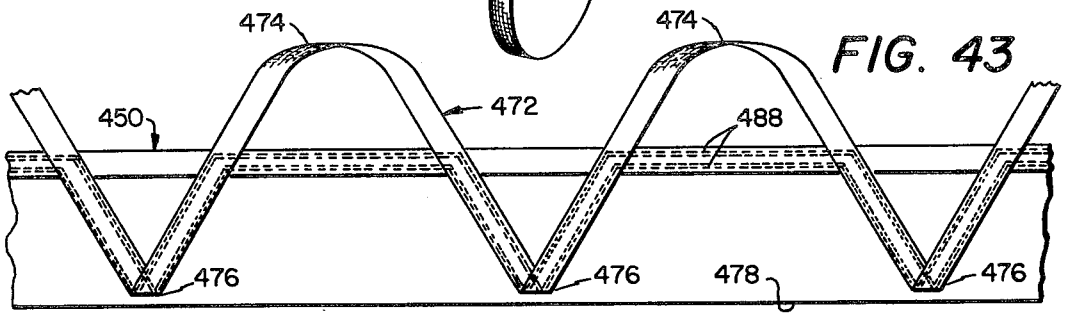
FIG. 43 is an illustration of a prefabricated lift loop structure made in accordance with FIG. 42.

FIG. 43 illustrates the result of the steps illustrated in FIG. 42. The length of fabric material 450 has a folded upper edge, with the layers comprising the fold being adhesively secured in place. The length of webbing material 470 is formed into a series of prefabricated lift loops 474. The lift loops 474 are equal in size and equally spaced along the length of fabric material 450. The lift loops 474 are secured to the length of fabric material 452 both adhesively and by means of sewing. Sewing lines 488 are formed first along the folded upper edge of the length of fabric material 450, and then along the length of webbing material 470 at its points of attachment to the length of fabric material 450 to form the lift loops 474. The length of webbing material 470 is twisted one half turn within each loop 474. Adjacent lift loops 474 are interconnected by folds 476 each positioned a predetermined distance from the adjacent edge 478 of the length of fabric material 450. The zones of attachment between the length of fabric material 450 and the length of webbing material 470 are of a V-shaped configuration with a predetermined angle therebetween and with the fold 476 comprising the vortex of each angle. In actual practice, the relationship between the attached portion of one lift loop 474 and the adjacent attached portion of the next lift loop 474 is preferably about 90°. That is, the angle between each attached lift loop portion and a line extending normal to the longitudinal axis of the length of fabric material 450 is about 45°.

The construction shown in FIG. 43 is utilized to manufacture a receptacle in exactly the same manner shown in FIGS. 39, 40 and 41 and described hereinabove in connection therewith. That is, the length of fabric material 450 having the lift loops 474 secured thereto is in turn secured around the upper end of a tubular receptacle construction. The length of fabric material 450 may be secured to the upper end of the tubular receptacle construction by means of an adhesive, or by means of sewing, or by means of a combination of the two techniques.

Figure 46:
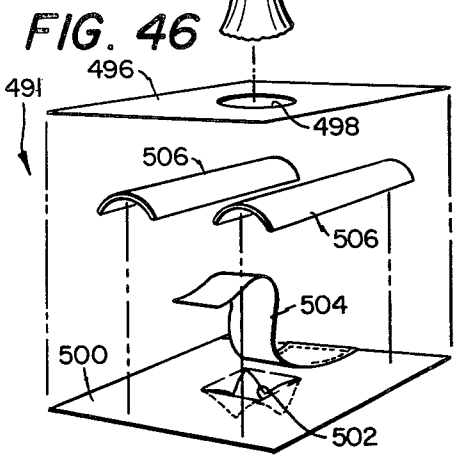
FIG. 46 is an illustration of an embodiment of the invention comprising an improved bottom wall construction.

FIG. 46 illustrates a bottom construction 491 which may be utilized in the practice of the invention. A discharge chute 492 is formed from a rectangular length of fabric material. The length of fabric material is rolled into a tube, and the overlapping edges are secured in place, either by means of an adhesive or by means of sewing. The upper end of the tubular construction is then folded outwardly to form a flange 494. An upper sheet 496 for the bottom construction 491 is formed from fabric. A circular aperture 498 is formed in the center of the upper sheet 496. The discharge chute is extended through the aperture 498 in the sheet 496 until the flange 494 engages the upper surface of the sheet 496. The discharge chute is then secured in place either by means of an adhesive or by sewing.

A lower sheet 500 for the bottom construction 491 is also formed from fabric. The lower sheet 500 has a rectangular aperture 502 formed in the center thereof. A length of fabric 504 is secured to the bottom sheet 500 by sewing and normally overlies the aperture 502 to form a protective closure.

A pair of semicircular lift fork receiving members 506 are positioned between the upper sheet 496 and the lower sheet 500 by the receptacle bottom construction. The lift fork receiving members 506 are preferably formed from cardboard, but may also be formed from other suitable materials, such as plastic.

The bottom construction 491 is completed by sewing the sheets 496 and 500 one to the other. Lines of stitching are extended along each edge of each lift fork receiving member 506 so that the members 506 are secured in place.

Figure 47:
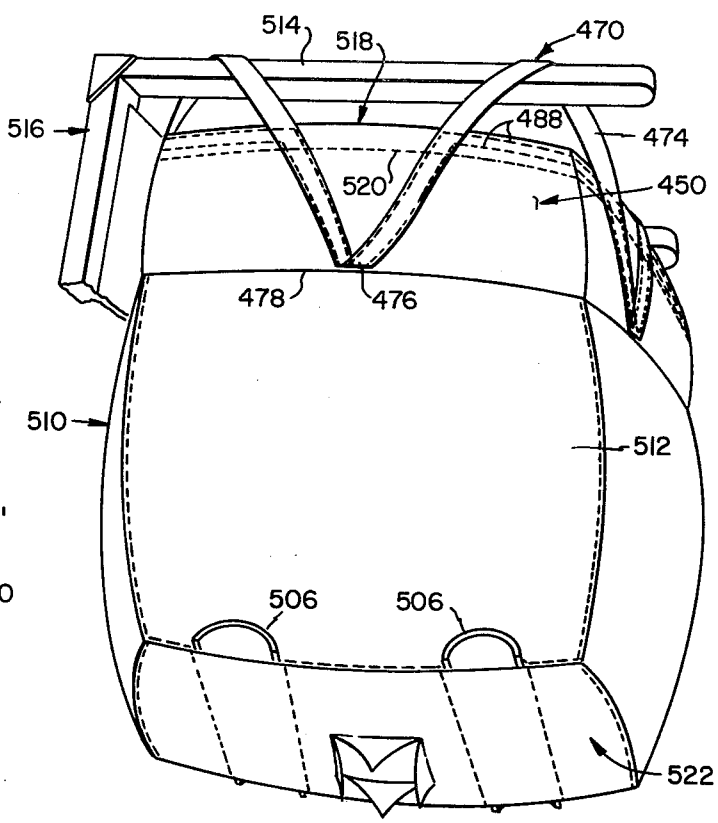
FIG. 47 is an illustration of a collapsible receptacle incorporating the prefabricated lift loop structure of FIG. 43 and the bottom wall construction of FIG. 46.

Referring now to FIG. 47, there is shown a collapsible receptacle 510 constructed in accordance with the embodiments of the invention illustrated in FIGS. 42, 43 and 46. The receptacle 510 has a side wall 512 formed from fabric material, preferably woven polypropylene or woven polyethylene material. The side wall 512 comprises a rectangular piece of fabric material which is rolled into a tubular configuration. The overlapping edges of the side wall 512 are then secured to each other, either by means of an adhesive or by means of sewing, or by a combination of both techniques.

The length of fabric material 450 shown in FIG. 43 is secured to the upper end of the sidewall 512 of the receptacle 510. The length of fabric material 450 is secured to the sidewall 512 either by means of an adhesive layer, or by means of sewing, or by means of a combination of the two techniques. The length of fabric material 450 is secured to the sidewall 512 with the lift loops 474 projecting above the upper end of the sidewall. The lift loops 474 are thus positioned to receive the lift forks 514 of a lift truck 516. With the lift forks 514 thus received in the lift loops 474 the lift truck 516 may be utilized to raise and lower the receptacle 510; to position the receptacle 510 for filling, for storage, or for discharge; etc.

The receptacle 510 further includes a top wall 518 secured to the upper end of the side wall 512 and serving to close the upper end of the receptacle. The top wall 518 may be fabricated in accordance with other aspects above the invention, for example, the top wall 518 may be fabricated as shown in FIG. 4. The top wall 518 may be secured to the upper end of the side wall 512 by means of a line of stitching 520 also serving to secure or to partially secure the length of fabric material 450 to the side wall 512.

The receptacle 510 also includes a bottom wall 522. The bottom wall 522 shown in FIG. 47 is of the type incorporating the embodiment of the invention illustrated in FIG. 46. Thus, the bottom wall 522 includes lift fork receiving members 506 adapted to receive the lift forks of a fork lift truck, whereby the receptacle 510 may be manipulated from the bottom, rather than from the top.

The receptacle 510 is normally positioned utilizing lift forks, such as the lift forks 514, received through the lift loops 474. However, in certain instances there may be insufficient room above the desired positioning of the receptacle to permit use of the lift loops 474 for manipulation of the receptacle. In such instances the members 506 may be utilized to receive lift forks such as the lift forks 514 of the lift truck 516.

Those skilled in the art will appreciate the fact that the receptacle 510 may be constructed utilizing the fabric material 450 and the loops 474 secured thereto without utilizing a bottom wall 522 of the type shown in FIG. 46. For example, the receptacle 510 may be fabricated utilizing a bottom wall of the type shown in FIG. 24. Conversely, the receptacle 510 may utilize the bottom wall construction shown in FIG. 46 without utilizing the fabric layer 450. For example, the various types of lift fork receiving loops shown in FIGS. 1, 35, 37 and 38 may be utilized in the receptacle 510 in lieu of the loops 474, or the receptacle 510 may be fabricated without any lift loops whatsoever.

Figure 44:
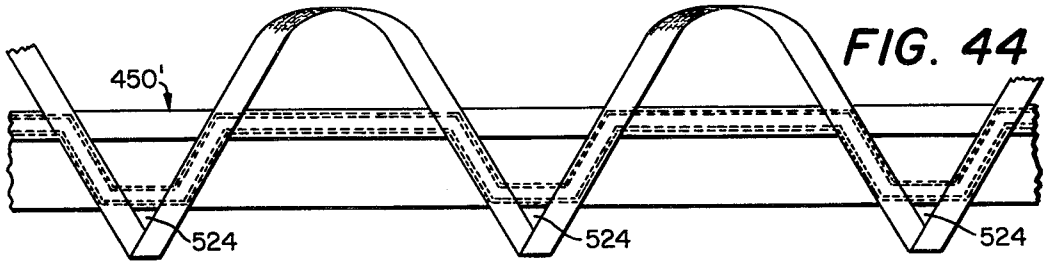
FIG. 44 is an illustration of an alternative lift loop structure.

Referring now to FIG. 44, there is shown a modification of the embodiment of the invention illustrated in FIGS. 42 and 43. In accordance with the modification of FIG. 44, various components are utilized which are substantially identical in construction and function to components utilized in the embodiment of FIGS. 42 and 43. Such identical components are indicated in FIG. 44 with the same reference numerals utilized in conjunction with FIGS. 42 and 43, but are differentiated therefrom by means of a prime (′) designation.

A fabric material 450′ has a folded upper edge which is adhesively secured in place. The length of webbing material 470′ is secured to the length of fabric material 450′ in the manner illustrated in FIG. 2, that is, preliminarily by means of an adhesive layer positioned between the length of fabric material 450′ and the length of webbing material 472′, and thereafter by means of sewing which results in lines of stitching 488′.

The length of webbing material 470′ is secured to the length of fabric material 450′ in the form of a series of lift loops 474′. The lift loops 474′ are identical in size and are positioned at spaced intervals along the length of fabric material 450. The length of webbing material 470′ is twisted one half turn within each loop 474.

The length of webbing material 470′ further includes a plurality of folds 476′. The sole distinction between the embodiment of the invention shown in FIG. 43 and the modification thereof shown in FIG. 44 is that in accordance with the modification of FIG. 44, the folds 476′ of the length of webbing material 470′ are positioned beneath the lower edge 478′ of the length of fabric material 450′. This produces a small open loop 524 situated between each fold 476′ and the adjacent lower edge 478′ of the length of fabric material 450′.

Figure 45:
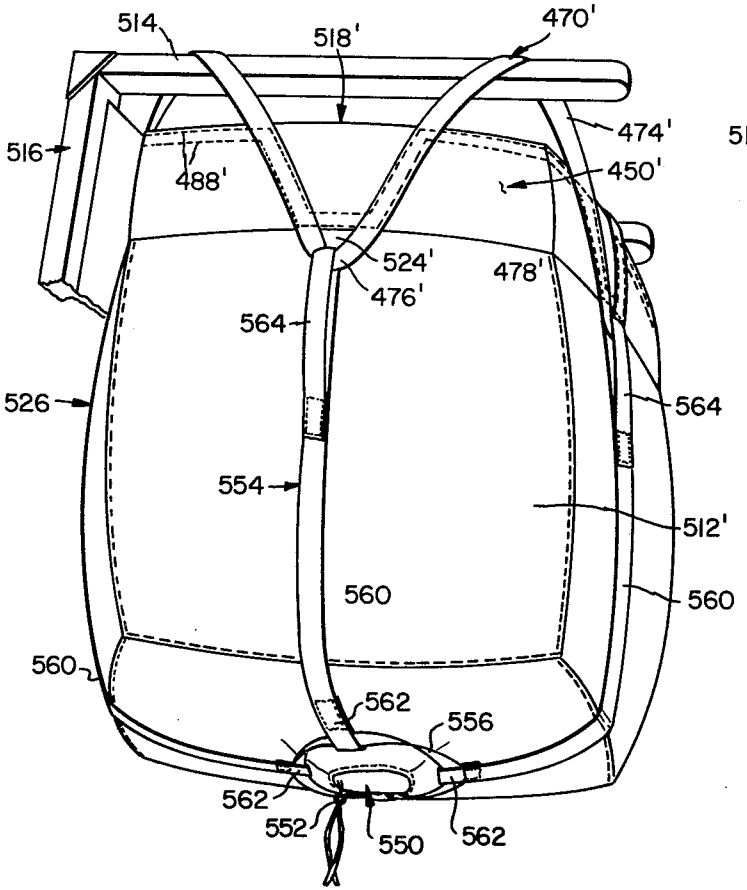
FIG. 45 is an illustration of a collapsible receptacle incorporating the prefabricated lift loop structure of FIG. 44.

Referring now to FIG. 45, there is shown a receptacle 526 incorporating the modification of FIG. 44. Many of the component parts of the receptacle 546 are substantially identical in construction and function to component parts of the receptacle 510 shown in FIG. 46 and discussed hereinabove in connection therewith. Such identical component parts are indicated in FIG. 45 by means of the same reference numerals utilized in FIG. 47, but are differentiated therefrom by means of a prime (′) designation.

The receptacle 546 has a bottom wall 548 formed in accordance with the teaching of FIG. 25. Such a bottom wall has a discharge spout 550 which is closed by means of a drawstring 552.

The receptacle 546 utilizes a sling 554. The sling includes a lower ring or loop 556 surrounding the discharge spout 550 of the bottom wall 548. The sling further includes four straps 560 each having loops 562 and 564 at the opposite ends thereof. Each loop 562 surrounds the lower loop 556, and each loop 564 extends through one of the loops 524 formed by the length of webbing material 570′ secured to the length of fabric material 450′. It will thus be understood that the lift loops 474 operate through the sling 554 to support the contents of the receptacle 526. The sling 554 is actually considered redundant because, as is true in the case of the receptacle 510 shown in FIG. 47, the fabric comprising the receptacle 526 is fully capable of supporting the contents thereof. However, in certain applications of the invention the use of an external sling is considered desirable, and in such instances the embodiment of FIG. 45 may be used.

The use of the embodiments of the invention shown in FIGS. 42, 43, 44, 45 and 47 is highly advantageous because, in accordance with certain applications of the invention, an individual lift loop of a receptacle must be capable of supporting the entire contents thereof while the remaining lift loops are entirely unsupported. As will be appreciated by reference to FIGS. 42–45 and 47, the lift loops therein disclosed are secured to the underlying length of fabric material at a substantial angle with respect a line extending normal to the longitudinal axis of the length of fabric material. By this means the weight of the contents of the receptacle is transferred to the lift loops in a direction tending to prevent stress concentrations which in turn prevents the lift loops from separating from the underlying structure of the receptacle.

Figure 48:
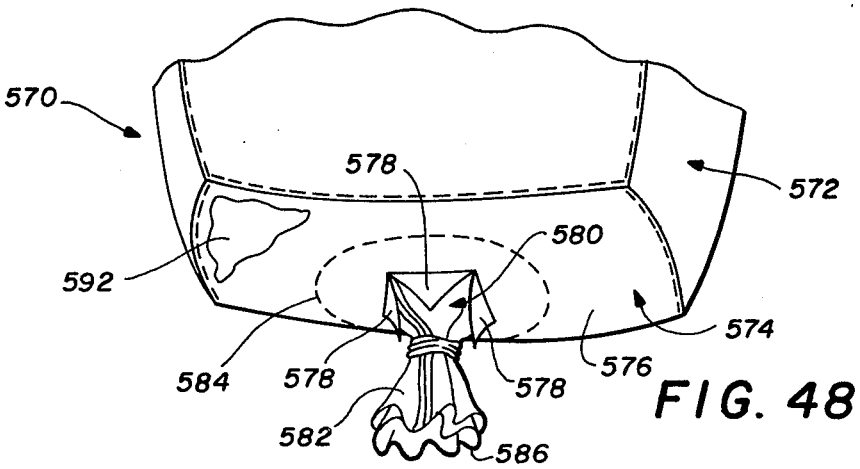
FIG. 48 is an illustration of the lower portion of a collapsible receptacle incorporating structure for static electric charge elimination.

Referring now to FIG. 48, there is shown a collapsible receptacle 570 incorporating yet another aspect of the invention. The receptacle 570 has a side wall 572 formed from fabric material, preferably woven polypropylene or woven polyethylene material. The side wall 572 comprises a rectangular piece of fabric material which is rolled into a tubular configuration. The overlapping edges of the side wall 572 are then secured to each other, either by means of an adhesive or by means of sewing, or by a combination of both techniques.

The receptacle 570 is preferably provided with a top wall. For example, the receptacle 570 may be provided with a top wall of the type shown in FIGS. 3 and 4 hereof. Regardless of the particular configuration of the top wall, it is secured to the upper end of the side wall 572 to close the top of the receptacle 570.

A bottom wall 574 is secured to the lower end of the side wall 572 and serves to normally close the bottom of the receptacle 570. Various bottom wall configurations may be utilized in the practice of the invention. For example, the bottom wall 574 may be of the type illustrated in FIG. 5 and described hereinabove in conjunction therewith. Alternatively, the bottom wall 574 may be of the type illustrated in FIG. 46.

Basically, the bottom wall 574 comprises a fabric layer 576 which is secured to the side wall 572, such as by means of sewing. Perpendicular slits are formed in the fabric layer 576 to define a plurality of flaps 578 which in turn define a rectangular opening 580 and the fabric layer 576. A tubular discharge spout 582 is provided with a flange at its upper end which is secured to the interior of the fabric layer 576 along a line of stitching 584.

Figure 49:
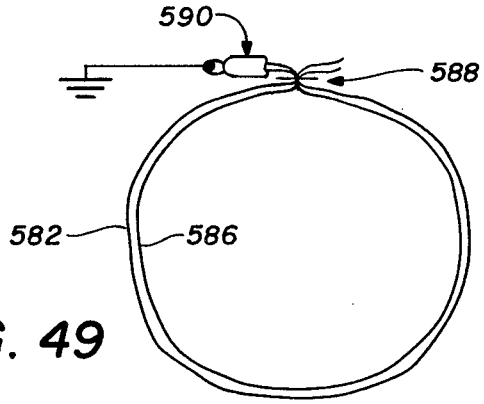
FIG. 49 is a sectional view through the discharge spout of the receptacle of FIG. 48.
Figure 50:
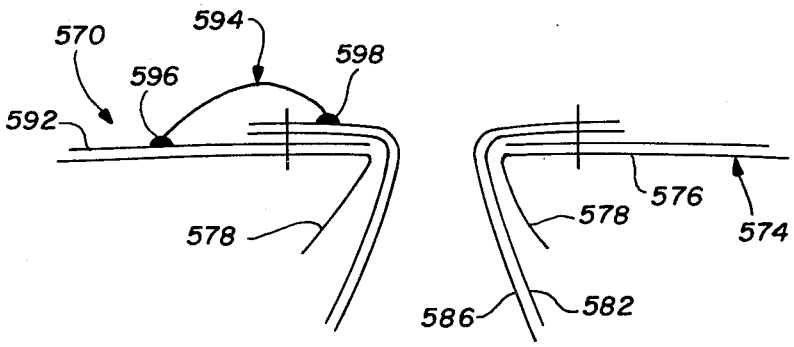
FIG. 50 is an enlarged partial sectional view showing part of the bottom wall and part of the discharge spout of the receptacle of FIG. 48.

In accordance with the aspect of the invention illustrated in FIGS. 48, 49 and 50, the discharge spout 582 has an electrically conductive interior surface. For example, a layer of electrically conductive material 586 may extend through the inside of the discharge spout 582. As is best shown in FIG. 49, the electrically conductive material 586 and the fabric layer comprising the discharge spout 582 are joined by means of a seam 588. This results in the electrically conductive layer 586 being positioned on the outside of the seam 588. By this means a typical alligator type connector 590 may be utilized to form an electrical connection to the layer 586 and is in turn connected to a source of ground potential.

The layer 586 of the discharge spout 582 is grounded during the discharge of material therethrough. This is for the purpose of preventing a buildup of static electric charge within the material as it is discharged from the collapsible receptacle 570 through the discharge spout 582. By maintaining the layer 586 at ground potential, any material floating out of the receptacle 570 is immediately grounded, thereby substantially reducing the extent of static electric charge buildup in the material as it is discharged.

Referring to FIGS. 48 and 50, the bottom wall 574 of the receptacle 570 may also be provided with an electrically conductive interior surface. As is perhaps best shown in FIG. 50, this may be accomplished by positioning a layer of electrically conductive material 592 on the inside of the fabric layer 576. Again, material flowing out of the collapsible receptacle 570 through the discharge spout 582 comes into contact with the electrically conductive layer 592 of the bottom wall 574, whereby any possible tendency to build up static electric charge in the material is substantially reduced or eliminated. It will be understood that the conductive layer 592 of the bottom wall 574 can be used without using the conductive layer 586 of the discharge spout 582, or that the conductive layer 586 of the discharge spout may be utilized without using the conductive layer 592 of the bottom wall, in accordance with the requirements of the particular applications of the invention.

The conductive layer 592 of the bottom wall 574 may be individually grounded. However, in certain embodiments of the invention it is considered advantageous to electrically interconnect the conductive material 586 of the discharge spout 582 and the conductive layer 592 of the bottom wall 576. To this end, an electrical lead 594 is connected to the layer 592 and to the material 586 at points 596 and 598, respectively. In some circumstances the lead 594 may comprise a short length of highly flexible wire which is secured to the material 586 and 592 by means of soldering, or other conventional techniques for forming electrical connections. Those skilled in the art will immediately appreciate the fact that various other conventional techniques may be utilized to electrically interconnect the layers 586 and 592.

Although preferred embodiments of the invention have been illustrated in the accompanying Drawings and described in the foregoing Detailed Description, it will be understood that the invention is not limited to the embodiments disclosed, but is capable of numerous rearrangements, modifications, and rearrangements of parts and elements without departing from the spirit of the invention.

We claim:

1. In a collapsible receptacle of the type comprising a tubular side wall, a top wall secured to the side wall around the upper end thereof for closing the upper end of the receptacle, a plurality of lift loops each secured to the side wall and extending upwardly above the upper end thereof for supporting the receptacle and the contents thereof, and a bottom wall secured to the side wall around a lower end thereof for closing the lower end of the receptacle, the improvement comprising:

a rectangular discharge spout blank having an outer layer and an electrically conductive inner layer;

means securing the discharge spout blank adjacent opposite edges thereof so that the blank is formed into a tubular configuration with a first portion of said inner layer located on the inside of said configuration, and a second portion of said inner layer extending beyond said securing means to expose said inner layer, said tubular configuration forming a discharge spout mounted in the bottom wall of the receptacle;

said discharge spout being normally closed for containing the contents of the receptacle therewithin and being selectively openable to release the contents of the receptacle to flow outwardly through the discharge spout so that upon release at least a portion of the receptacle contents engage the electrically conductive inner layer of the discharge spout; and means for connecting the second portion of said electrically conductive inner layer of the discharge spout to a source of predetermined electric potential and thereby controlling the buildup of static electricity in the contents of the receptacle upon release thereof through the discharge spout.

2. The improvement according to claim 1 wherein the discharge spout has a predetermined length and a predetermined internal circumference, and wherein the electrically conductive inner layer of the discharge spout extends the entire length thereof and around the entire interior circumference thereof.

3. The improvement according to claim 2 further characterized by means forming an electrically conductive inner surface on the bottom wall of the receptacle, and means for electrically interconnecting the electrically conductive inner surface of the bottom wall and the electrically conductive inner layer of the discharge spout.

4. In a collapsible receptacle of the type comprising a tubular side wall, a top wall secured to the side wall around the upper end thereof for closing the upper end of the receptacle, a plurality of lift loops each secured to the side wall and extending upwardly above the upper end thereof for supporting the receptacle and the contents hereof, and a bottom wall secured to the side wall around the lower end thereof for closing the lower end of the receptacle, the improvement comprising:

a rectangular discharge spout blank having an outer layer and an electrically conductive inner layer;

means securing the discharge spout blank adjacent opposite edges thereof so that the blank is formed into a tubular configuration with a first portion of said inner layer located on the inside of said configuration, and a second portion of said inner layer extending beyond said securing means to expose said inner layer, said tubular configuration forming a discharge spout mounted in the bottom wall of the receptacle;

means for connecting the second portion of said electrically conductive inner layer of the discharge spout to a source of predetermined electric potential and thereby controlling the buildup of static electricity in the contents of the receptacle upon release thereof through the discharge spout;

means forming an electrically conductive inner surface on the bottom wall of the receptacle; and means for connecting the electrically conductive inner surface of the bottom wall to the source of predetermined electric potential.

5. The improvement according to claim 4 wherein the means forming an electrically conductive surface of the bottom wall comprises a layer of electrically conductive material extending over the entire interior surface of the bottom wall of the receptacle.

6. A collapsible receptacle comprising: a tubular side wall;

a top wall secured to the side wall around the upper end thereof for closing the upper end of the receptacle;

a plurality of lift loops each secured to the side wall and extending upwardly above the upper end thereof for supporting the receptacle and the contents thereof;

a bottom wall secured to the side wall around the lower end thereof for closing the lower end of the receptacle;

a layer of electrically conductive material comprising the interior surface of the bottom wall;

a rectangular discharge blank having an outer layer and an electrically conductive inner layer;

means securing the discharge spout blank adjacent opposite edges thereof so that the blank is formed into a tubular configuration with a first portion of said inner layer loated on the inside of said configuration, and a second portion of said inner layer extending beyond said securing means to expose said inner layer, said tubular configuration forming a discharge spout mounted in the bottom wall of the receptacle;

means for connecting the second portion of said electrically conductive inner layer of the discharge spout to a source of predetermined electric potential and thereby controlling the buildup of static electricity in the contents of the receptacle upon release thereof through the discharge spout;

means for electricity interconnecting the electrically conductive layers of the bottom wall and the discharge spout.

* * * * *